US006745001B2

(12) United States Patent
Wright et al.

(10) Patent No.: US 6,745,001 B2
(45) Date of Patent: Jun. 1, 2004

(54) WEB CONDITIONING CHARGING STATION

(75) Inventors: Graham S. Wright, Brockport, NY (US); Jorge L. Chavez, Spencerport, NY (US)

(73) Assignee: Nexpress Solutions LLC, Rochester, NY (US)

( * ) Notice: Subject to any disclaimer, the term of this patent is extended or adjusted under 35 U.S.C. 154(b) by 81 days.

(21) Appl. No.: 10/139,434

(22) Filed: May 6, 2002

(65) Prior Publication Data

US 2003/0206755 A1 Nov. 6, 2003

(51) Int. Cl.[7] ..... G03G 15/01
(52) U.S. Cl. ..... 399/303; 399/312
(58) Field of Search ..... 399/89, 115, 128, 399/170, 171, 303, 312, 315, 306, 296; 361/213, 214, 229, 235

(56) References Cited

U.S. PATENT DOCUMENTS

| | | | | |
|---|---|---|---|---|
| 3,470,417 A | | 9/1969 | Gibbons | |
| 3,475,652 A | * | 10/1969 | Levy | 361/213 |
| 3,730,753 A | | 5/1973 | Kerr | |
| 4,096,543 A | * | 6/1978 | Kozuka et al. | 361/230 |
| 4,245,272 A | | 1/1981 | Rushing et al. | 361/229 |
| 4,456,365 A | * | 6/1984 | Yuasa | 399/171 |
| 4,486,808 A | | 12/1984 | Cardone | 361/235 |
| 4,737,816 A | | 4/1988 | Inoue et al. | |
| 4,914,737 A | | 4/1990 | Amemiya et al. | |
| 5,059,990 A | * | 10/1991 | Abreu et al. | 347/153 |
| 5,132,737 A | | 7/1992 | Takeda et al. | |
| 5,432,454 A | * | 7/1995 | Durkin | 324/452 |
| 5,589,922 A | | 12/1996 | Amemiya et al. | 399/315 |
| 5,890,046 A | | 3/1999 | Amemiya et al. | 399/315 |
| 5,895,632 A | * | 4/1999 | Nomura et al. | 422/186.04 |
| 6,160,980 A | * | 12/2000 | Ziegelmuller et al. | 399/303 |
| 6,205,309 B1 | | 3/2001 | Gundlach et al. | 399/170 |

FOREIGN PATENT DOCUMENTS

| | | | | |
|---|---|---|---|---|
| JP | 55038525 A | * | 3/1980 | G03G/15/16 |
| JP | 56062266 A | * | 5/1981 | G03G/15/02 |
| JP | 09034222 A | * | 2/1997 | G03G/15/02 |

* cited by examiner

*Primary Examiner*—Robert Beatty
(74) *Attorney, Agent, or Firm*—Lawrence P Kessler

(57) ABSTRACT

A method and apparatus for conditioning a moving transport web for neutralizing or modifying polar charge density and net charge density on the moving transport web included, for example, in an electrostatographic printer. The web conditioning includes a charging station which has a first stage including two open-wire AC corona chargers facing one another across the transport web, and downstream, a second stage including two gridded AC corona chargers facing one another across the transport web. The grids of the gridded AC corona chargers are preferably grounded, the AC waveforms for energizing the corona wires of the open-wire chargers and the gridded chargers are preferably quasi trapezoidal with no applied DC offsets, with preferably preselected asymmetries in the spacings from the web in the first and second stages. The first stage accomplishes at least about 80% of said neutralizing of said polar charge density.

45 Claims, 13 Drawing Sheets

WEB CONDITIONING CHARGING STATION

FIELD OF THE INVENTION

This invention relates to controlling electrostatic charge and voltage on a moving dielectric web, and more particularly to electrostatography and to apparatus and method for control of electrostatic charge and voltage on a receiver-transporting web in an electrostatographic printer.

BACKGROUND OF THE INVENTION

Prior art discloses apparatus for applying corona charges to a moving web, or to sheets supported by a moving web. In many cases it is desirable to apply the corona charges by one or more corona chargers, with a purpose of neutralizing electric fields resulting from extraneous electrostatic charges residing on the surfaces of the web, or within the interior of the web. In other cases, it is required to produce a uniformly charged web, or a web having a uniform average voltage which may be positive, negative, or zero. Such a uniform average voltage may be characterized by a variance from a mean voltage, and the variance may for example be required to be less than a predetermined variance.

The Gibbons patent (U.S. Pat. No. 3,470,417) discloses electrical conditioning of a bare web by gridded corona chargers located on opposing sides of a moving dielectric web, each corona charger energized by a DC voltage, which electrical conditioning can produce a predetermined potential on each face of the web and can also be used to neutralize substantially all charge on a web.

The Kerr patent (U.S. Pat. No. 3,730,753) describes a method for removing a nonuniform charge distribution from a web that has previously been treated by an AC corona discharge for purpose of making the web coatable by an emulsion. The method involves flooding the corona discharge treated surface with negative charge by a high voltage negative DC non-gridded corona charger, followed by reducing the surface charge on the web to approximately zero by a high voltage positive DC non-gridded corona charger.

The Rushing et al. patent (U.S. Pat. No. 4,245,272) discloses a so-called "boost and trim" corona charging method for charging a moving dielectric film or web, e.g., a photoconductor. The "boost" produces an overcharging of the photoconductor at the beginning of the process of charging a given area of the film, and the "trim" subsequently reduces this overcharge so as to give a predetermined exit voltage as the given area leaves the "boost and trim" charger. A "boost and trim" charger as described in U.S. Pat. No. 4,245,272 is a multiple open wire charger (no grid) with each wire energized by a DC-biased AC voltage source. Typically, an AC signal is applied in common to all wires of the charger, with a different DC potential applied to each wire. The waveform shape of the AC signal is not specified.

The Cardone patent (U.S. Pat. No. 4,486,808) discloses an open-wire (no grid) corona charger energized by an AC voltage and located on one side of a dielectric web, and an open-wire DC-biased AC charger located on the other side of the dielectric web. The waveform shape of the AC voltage is not specified.

The Inoue et al. patent (U.S. Pat. No. 4,737,816) discloses a detack charger assembly for neutralizing charges on a toned receiver member carried by a transport belt, which neutralizing allows the receiver member to be readily removed from the belt by a pawl. The detack charger assembly has two opposed corona chargers, and the toned receiver member on the transport belt is moved between them. Each of the chargers is energized by an AC voltage which may include a DC offset, the AC voltages being applied to the two chargers 180 degrees out of phase with one another. The waveform shape of each AC voltage is not specified. It is also briefly disclosed that a grid may be used on a charger to control the charging current.

In the Amemiya et al. patent (U.S. Pat. No. 4,914,737) a corona discharge device is used following a corona transfer device for transferring toner from a photoconductive primary imaging member to a receiver (paper), the receiver supported by a dielectric sheet member during both transfer of the toner and during operation of the corona discharge device. The corona discharge device includes two single-wire non-gridded corona chargers, i.e., an outer corona charger facing the toner on the front side of the receiver (after transfer of the toner from the primary imaging member to the receiver) and an inner corona charger facing the back side of the dielectric sheet member. An AC voltage is applied to both corona chargers, the AC voltages being out of phase with one another. The waveform shape of each AC voltage is not specified. An appropriate DC bias voltage may be applied to either or both of the outer and inner corona chargers.

The Takeda et al. patent (U.S. Pat. No. 5,132,737) discloses a pair of single-wire non-gridded corona dischargers (voltage excitation waveforms not specified) for post-transfer use with a dielectric carrying sheet supporting a toned transfer material such as paper, with one of the corona dischargers disposed facing the toned transfer material and the other corona discharger disposed facing the back side of the dielectric carrying sheet.

The Amemiya et al. patents (U.S. Pat. Nos. 5,589,922 and 5,890,046) disclose opposed open-wire non-gridded corona discharge devices, disposed similarly to the open-wire corona discharge devices of the Amemiya et al. patent (U.S. Pat. No. 4,914,737) and similarly employing mutually out-of phase AC voltage waveforms including DC offsets, certain embodiments using plural corona wires. The AC waveform shapes are not specified.

A commercial corona discharger assembly for neutralizing static charges on both sides of a dielectric web is manufactured by HAUG GmbH of Leinfelden-Echterdingen, Germany. An AC Power pack (catalog number EN-70 LC) is utilized for energizing four "ionizing bars" (catalog number EI-RN), the ionizing bars mounted as two successive pairs, one ionizing bar of each pair disposed on either side of a dielectric web, each ionizing bar powered by an AC sinusoidal waveform such that the two waveforms of each pair are 180 degrees out of phase. No DC offset biases are specifically described, nor are grids included with the ionizing bars.

Several commercial electrophotographic printing machines (e.g., Xerox Docucolor 40, Ricoh NC 8015, Canon CLC 1000) employ an endless insulating transport belt for carrying receivers through multiple successive transfer stations so as to build up a multicolor toner image on each receiver, in which machines the endless transport belt, after detack of the receivers, is passed through a charging apparatus for neutralizing unwanted surface charges and/or for use as a pre-clean charging station prior to cleaning the transport belt. In a Xerox Docucolor 40, a pair of opposed single wire AC pre-clean corona chargers having metal shells and no grids are disposed on opposite sides of the transport belt, the chargers using square wave excitation at a frequency of about 1000 Hz. A Ricoh NC 8015 machine uses an open-wire AC charger on the front side of the transport belt, the charger opposed by a roller on the back side of the belt. The Canon CLC 1000 machine includes a detack station which detack station includes a DC-biased open-wire AC charger opposed by a roller, a post-detack roller nip having grounded rollers through which the transport web passes so as to even out the potential differences between frame and interframe areas, with the post-detack roller nip followed by a back-side web cleaner that also functions as a static charge eliminator.

The Gundlach et al. patent (U.S. Pat. No. 6,205,309) discloses an AC corona charger wherein a corona wire is coupled through a capacitative connection to an AC voltage source, the corona wire partially surrounded by a conductive shield connected to a DC voltage source. The presence of a capacitance between the AC voltage source and the corona wire ensures that equal numbers of positive and negative corona ions are generated at the wire, with the DC potential controlling the net charging current, e.g., for purpose of charging a photoconductive member. It can be inferred that by setting the DC potential close to zero, the charger may be used as a neutralizer.

There remains a need for an improved non-contacting web conditioning charging apparatus for effectively removing nonuniform charge distributions from a moving dielectric member, e.g., for neutralizing extraneous electrostatic charges on the front and back surfaces of a moving dielectric web, where the incoming web entering the charging apparatus may have a potential difference across the web of thousands of volts, e.g., 4,000 volts or higher across a 100 $\mu$m thick web. In particular, there remains a need for an improved corona charging device having high reliability and robustness for the smoothing or neutralizing of nonuniform electrostatic charge distributions on the surfaces of a rapidly moving transport web, such as a transport web used for transporting receiver members through successive imaging modules of a modular electrostatographic color printing machine. There is an additional need for the neutralizing or smoothing to be carried out on the entire operational area of such a transport web, the operational area including area portions of the web from which toned receiver members have been detached, e.g., without the use of a detack charger.

SUMMARY OF THE INVENTION

Accordingly, this invention is directed to a robust and reliable web conditioning charging station (WCCS) for repeatably controlling electrostatic charge and voltage on a moving dielectric web. In a preferred embodiment, the WCCS is used for neutralizing electrostatic charge. In another embodiment, the WCCS is used for providing a predetermined, uniform, potential difference across the web. The WCCS has a first stage and a second stage through which the web moves. The first stage includes an opposed pair of open wire (no grid) corona chargers facing one another on opposite sides of the web, each charger energized by an AC voltage waveform and the two waveforms mutually 180° out of phase. The second stage includes a second pair of corona chargers, each charger of the second pair provided with an electrically biased grid member and the chargers facing one another on opposite sides of the web, with each charger of the second pair energized by an AC voltage waveform and the two waveforms of the second pair mutually 180° out of phase. In a preferred embodiment, for use to condition a transport web (TW) in an electrophotographic color printer optionally having no detack charger, the AC voltage waveforms for energizing the first and second stages are quasi-trapezoidal with zero DC offsets, the waveforms of the first and second stage chargers are in phase on either side of the web, and the grid members of the second pair of chargers are at ground potential.

The invention, and its objects and advantages, will become more apparent in the detailed description of the preferred embodiment presented below.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus may be modified. For clarity of understanding of the drawings, some elements may not be shown, and relative proportions depicted or indicated of the various elements of which disclosed members are composed may not be representative of the actual proportions, and some of the dimensions may be selectively exaggerated.

DETAILED DESCRIPTION OF THE INVENTION

Figure 1:
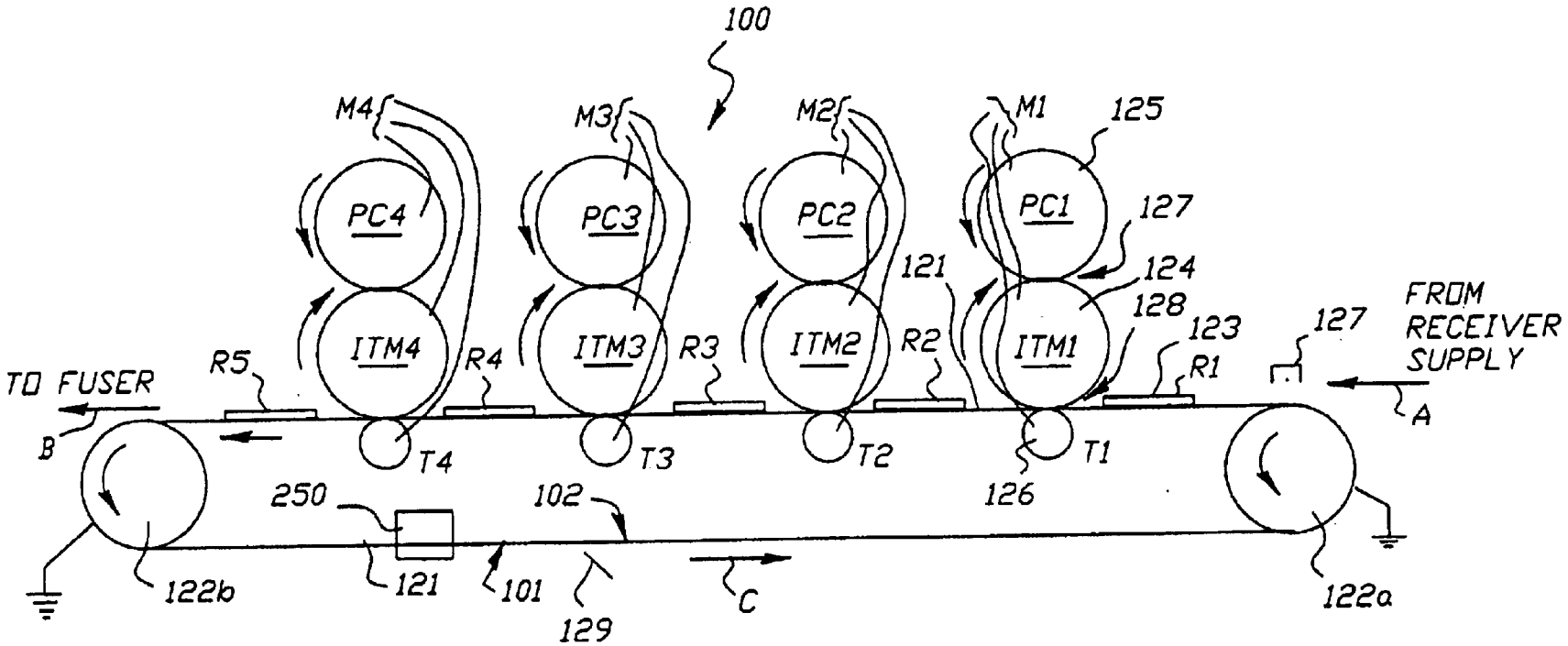
FIG. 1 shows a simplified side elevational view of an exemplary modular electrophotographic color printer, in which a web conditioning charging station of the invention may be included for modifying, e.g., neutralizing, electrostatic charge distributions on a receiver transport web included in the printer.

This invention relates to controlling electrostatic charge and voltage on a moving dielectric web. More particularly, the invention relates to electrostatography, and provides a method and apparatus for use in modifying, e.g., neutralizing, electrostatic charge distributions on a receiver-transporting web included in an electrostatographic color printing machine. The color printing machine typically includes at least one electrostatographic imaging module in a plurality of tandemly arranged electrostatographic imaging-forming modules. In each module, a single-color toner image is transferred from a respective moving primary image-forming member, e.g., a photoconductive drum, to a moving receiver member passing through the module. The receiver member is moved progressively through the imaging-forming modules by the receiver-transporting web, and in each module the respective single-color toner image is transferred, e.g., electrostatically, from the respective primary image-forming member to a respective intermediate transfer member and from thence to the moving receiver member adhered to the receiver-transporting web. The respective single-color toner images are successively laid down in registration one upon the other on the receiver member so as to complete, in the last of the modules, a multicolor toner image, e.g., a four-color toner image from four modules, which receiver member is then moved to a fusing station where the multicolor toner image is fused to the receiver member. Alternatively, in each module the respective single-color toner image is transferred without use of an intermediate transfer member directly from the respective primary image-forming member to the moving receiver member so as to complete, after successive transfers of single-color toner images in each of the modules, a multicolor toner image on the receiver member. A single-color toner image may be made from a conventional colored toner such as for example a cyan, magenta, yellow, or black toner, or may include one or more of a colorless or clear toner, a specialty color toner, or any other toner designed for unusual or special usage.

The above described printers have as a common feature a moving receiver-transporting web or belt (henceforth, transport web or TW) for transporting successive receiver sheets through the modules, which receiver sheets are held, e.g., electrostatically, to the transport web while passing through the modules. After a full-color toner image has been formed on a receiver in the last of the modules, the receiver is separated or detacked from the outer surface of the transport web for subsequent movement of the receiver to the fusing station. It is well-known that prior to detack and after movement by the transport web of an electrostatically adhered receiver through the last module, the receiver can be passed through a so-called "detack" corona charging station for aiding detacking by reducing or eliminating electrostatic charges or electric fields causing electrostatic adhesion of the receiver to the transfer web. Alternatively, the detack corona charging station can be optional and may be advantageously omitted in certain printers, e.g., in a printer utilizing the present invention. To provide detack, a mechanical action, e.g., as can be produced by a pawl or other suitable mechanical device, may if necessary be used to help separate the toned receiver from the transport web, after which the receiver is moved, e.g., on a system of rollers, to the fusing station. The transport web typically has the form of a rotatable endless belt, the web being continuously rotated during operation of the printer. Areas of the transport web from which receivers have been removed for fusing are thus rotated to a location where untoned receiver members are electrostatically adhered for passage through the imaging modules to create multicolor images thereon.

Following an electrostatic tackdown of a receiver member to the transport web and successive electrostatic transfers of single-color toner images to the receiver member passed through the modules, and after the toned receiver member has been subsequently detacked from the transport web, the transport web typically carries post-detack electrostatic charges which can include surface charges, dipolar charges, and in certain cases, internal space charges. Areas from which toned receiver members have been detacked are typically charged differently from surrounding areas, and therefore have different voltages. As a result, before the transport web is rotated so as to receive untoned receiver members, the post-detack charge distribution needs to be modified so as to provide a suitably usable uniform distribution of charges on the transport web. Typically, the post-detack electrostatic charges are removed or neutralized by suitable apparatus with the object of driving any incoming potential difference across the transport web close to zero, and the subject invention provides such neutralization. The subject invention also provides improved apparatus and method for generating a controlled potential difference across the transport web and for smoothing post-detack electrostatic charge distributions on both the outer (front) surface and the inner (back) surface of the transport web.

It is common practice to define a net charge per unit area (or net charge density) contained on an electrostatically charged web, which net charge is the arithmetic sum of all positive and negative charges in a given area of the web, and which given area includes the interior as well as the outer and inner faces of the web. It is also common to define a polar charge per unit area (or polar charge density) on an electrostatically charged web, which polar charge density is equivalent to an average positive surface charge per unit area on one face of the web compensated by an equal and opposite average negative surface charge per unit area on the opposing face of the web. One of the faces of the given area always exhibits a charge magnitude having an absolute value equal to the polar charge, and the opposing face exhibits a charge magnitude which is equal to the polar charge plus the absolute magnitude of the net charge. For example, let there be 20 positive charges and 5 negative charges on a small area of the front face, and 27 negative charges and 4 positive charges on the corresponding opposing small area of the back face: the average charge on the front face area is +15 and on the back face area is −23, and the situation for this small area may therefore be described by a polar charge of 15 and a net charge of −8. The amounts of net charge and polar charge per unit area on the transport web, and their associated electrostatic fields, are typically nonuniform and give rise to varying voltage from place to place on the web, e.g., after detack of the receiver member.

There is a need for modifying post-detack charge densities on both sides of the transport web so as to provide suitably uniform surface potentials prior to adhering a new receiver member for passage through the modules. The present invention provides an improved web conditioning charging apparatus and method for producing such suitably uniform surface potentials. In a preferred embodiment, the web conditioning charging apparatus acts as a charge neutralizer, such that the average residual voltage (due to polar charge) remaining across the moving web after passage through the web conditioning charging apparatus is uniform and consistently close to zero over long periods of operation of the web. For this embodiment, the web conditioning charging apparatus substantially neutralizes the polar charge when the magnitude of incoming polar charge on the web is as high as about 1.2 millicoulombs per square meter, equivalent to about ±4500 volts across a typical web used in an electrostatographic printer. In an alternative embodiment, any suitable (non-zero) predetermined potential difference across the transport web is produced downstream of the web conditioning charging apparatus. For both of these embodiments, the improved web conditioning charging apparatus of the invention is robust against the magnitude of the (variable) incoming voltage on the transport web.

It is a standard feature in electrostatographic printers including a transport web to make toned control or reference patches for each single color, i.e., in each module, the reference patches being sequentially transferred to the web. The reference patches or process control patches are used to monitor and control operation of the individual modules, e.g., by real time measurements of reflection optical densities of the patches by one or more suitably located density-measuring devices, and using a feedback system to control relevant operational devices in the modules so as to make measured optical densities match predetermined aim values. The process control reference patches are laid down on the web in suitable areas not covered by receiver members, typically in the inter-frame areas of the web, i.e., in the spaces between successive receiver sheets. The deposits of toner in the patches are cleaned off during each revolution by a patch cleaning device, e.g., a blade cleaning device, and it is preferably a function of the web conditioning charging apparatus of the invention to neutralize the electrostatic charges on the toner particles in the patches so as to make the particles readily removable by the patch cleaning device.

The use of a detack charger in conjunction with the web conditioning charging station of the invention is optional. A preferred embodiment of the web conditioning charging station is generally operable without a detack charging station in the printer. When no detack charging station is employed, purely mechanical forces are used or taken advantage of in order to separate, from the transport web, receiver members which have passed through the modules. Omission of a detack charger from the printer is advantageous, not only in reducing the cost of the printer, but also in reducing the complexity of the printer and thereby improving the reliability of operation.

Referring now to the figures, an exemplary electrostatographic four-module printer for use with the invention (see for example U.S. Pat. No. 6,184,911) is indicated by the numeral 100 in FIG. 1, wherein each module is capable of producing an image with one of the single color toners, such as for example cyan, magenta, yellow, and black toners. More or fewer than four modules may be used, and specialty toners, such as for example colorless toners or special color toners, may also be used. The simplified drawing of FIG. 1 shows only basic components (see for example FIG. 2 for more detail). A first module indicated as M1 includes: a primary image forming member, e.g., in the form of a photoconductive (PC) drum or roller 125 labeled PC 1, the roller 125 having a photoconductive structure surrounding a typically conductive core (photoconductive structure and core not shown); an intermediate transfer member (ITM) typically in the form of a compliant drum or roller 124 labeled ITM1; and, a typically electrically biased transfer backup roller 126 labeled T1. The other modules are similarly constructed, each module including a photoconductive drum, an ITM, and a transfer backup drum or roller, such as indicated in FIG. 1 for module M4. In printer 100, module M1 may produce for example a cyan toner image. PC drum 125 rotating counterclockwise as shown is charged, for example negatively, by a suitable charger (the charger, not shown, may include for example a corona charging device, a roller charger, or a brush charger) and then image-wise exposed by an exposure device, such as an electro optical digital device including a laser scanner or LED array, an optical exposure device, or other suitable exposure device (exposure device not shown). The resulting electrostatic image is then developed, typically using the well-known discharged area development technique, by bringing the electrostatic latent-image bearing PC1 into proximity of an electrostatographic developer such as contained in a development station in the same module (not shown), the developer containing charged toner particles, e.g., negatively charged toner particles. The cyan toner image is then transferred, typically electrostatically, in a primary transfer nip labeled 127 from the PC1 to intermediate transfer member 124, with PC1 preferably grounded and ITM1 suitably electrically biased and rotating clockwise as shown. PC1 is subsequently cleaned in a cleaning station (not shown) prior to creating another latent electrostatic image on PC1 by charging and imagewise exposing. A receiver sheet 123, labeled R1, is transported in direction of arrow A from a receiver supply unit (not shown) and, according to the most typical option, electrostatically adhered or tacked to the outer surface 101 of an endless transport web (TW) 121 by a tackdown charging device, e.g., tackdown corona charger 127. Alternatively, grippers may optionally be used to hold receiver members to the transport web. TW 121 is moved to the left, e.g., by counterclockwise rotation of rollers 122*a* and 122*b* which are provided with a motor drive, the rollers in contact with the inner surface 102 of TW 121. As shown, tackdown corona charger 127 is situated in opposition to the grounded roller 122*a*, or alternatively, charger 127 may be situated in opposition to a separate grounded member, such as a conductive roller or skid (not illustrated). In apparatus 100, receiver member 123, for example a paper or a plastic transparency sheet, moves away from tackdown charger 127 and arrives in a secondary transfer nip 128 where the cyan toner image is electrostatically transferred to R1, using the suitably biased backup transfer roller 126 labeled T1. In lieu of the backup transfer roller 126, a corona device may be used to induce transfer of the cyan toner image to R1, as is well known. To build up a full-color print on a receiver, other single color toner images (e.g., magenta, yellow and black) are respectively sequentially transferred to the receiver member in otherwise similar modules M2, M3 and M4 as the receiver member is transported from one module to another. Fewer than four modules may be used and additional modules can be added if desired. As a cyan image is being transferred to R1 in module M1, other color separation images may be (simultaneously) transferred to receivers R2, R3 and R4 in modules M2, M3 and M4, respectively. A completed unfused full-color print, e.g., R5 is detacked in the vicinity of roller 122*b* and then transported in the direction of arrow B to a fuser in a fusing station wherein the toner image is permanently fixed to the receiver by heat and/or pressure (fusing station not shown). As is well known, detacking of receivers can be aided by use of a detack charging device, typically a corona charger (not illustrated) situated for example in opposition to the grounded roller 122*b*, or alternatively situated in opposition to an additional grounded conductive member such a skid or roller (not illustrated). Alternatively, as is often practiced, a detack charging device is not used and the detacking of receiver members can occur by taking advantage of inherent stiffness of a receiver member, such that a receiver member does not follow the path of the transport belt 121 around roller 122*b* but separates spontaneously as a result of the inherent resistance to mechanical bending of the receiver member. After moving around roller 122*b*, transport web 121, moving in direction of arrow C, may be passed through a web conditioning charging station 250 of the invention (web conditioning charging station shown in detail in FIG. 2).

In lieu of photoconductive drums which are preferred, e.g., PC1, photoconductive belts may be used.

In lieu of intermediate transfer member drums which are preferred, e.g., ITM1, intermediate transfer member belts may be used.

As an alternative to electrophotographic printing, there may be used electrographic recording to make each single-color toner image, e.g., by utilizing stylus recorders or other known electrographic recording devices for creating electrostatic images on dielectric members, e.g., on dielectric rollers or webs in lieu of drums PC1,2,3,4. Broadly, each single-color toner image is formed using electrostatography.

A receiver member, utilized with a web conditioning charging station of the invention in printer 100, can vary substantially. For example, a receiver member can be thin or thick, and may for example be made of paper, plastic-containing materials, materials including fibers or filaments, and fabrics. A receiver member may be in sheet form, including various cut sheet paper stocks or transparency stocks, or alternatively, the receiver member may be in the form of a web.

The transport web TW 121 is typically cleaned of foreign matter by use of a web cleaning station 129, including for example a blade cleaning device, e.g. when web 121 is moving in direction of arrow C (see below).

Mechanical fingers (not shown in FIG. 1) can be employed to receive and support a receiver being detacked from TW 121 for transport to the fuser. In a printer 100 including the web conditioning charging station of the invention, a receiver member, before reaching the supporting fingers, moves over a gap distance typically in a range of approximately 0.01 inch–0.1 inch, and more usually, about 0.02 inch.

The tackdown charging device 127 may be any suitable charging device such as for example a roller charger or a brush charger, but is typically an ungridded charger including a high voltage corona wire and a shell (wire and shell not labeled in FIG. 1). In printer 100, the corona charger 127 is typically energized by a DC source with the shell made of a conductive material and preferably grounded. Alternatively, charger 127 may be an AC charger including a dielectric shell.

When electrostatic hold down of a receiver member is not employed in printer 100, transport web TW 121 is typically made of a material having a bulk electrical resistivity greater than about $10^5$ ohm-cm, and more typically, between about $10^8$ ohm-cm and $10^{11}$ ohm-cm. When electrostatic hold down of the receiver member is employed, the transport web will usually have a bulk resistivity of greater than about $10^{12}$ ohm-cm. This bulk resistivity is the resistivity of at least one layer if the belt is a multilayer article. The web material may be made of any of a variety of flexible dielectric materials such as a fluorinated copolymer (e.g., polyvinylidene fluoride), polycarbonate, polyurethane, polyethylene terephthalate, polyimides (e.g., Kapton™), polyethylene napthoate, or silicone rubber. Whichever material that is used, such web material may contain an additive, such as an anti-stat (e.g. metal salts) or small conductive particles (e.g. carbon), to impart the desired resistivity for the web. In apparatus 100, the endless web TW 121 is typically made of a single dielectric layer, is relatively thin (20 $\mu$m–1000 $\mu$m), and is flexible. For use in conjunction with the web conditioning charging station of the invention, TW 121 can have any suitable thickness which is typically in a range of approximately 50 $\mu$m–200 $\mu$m. The dielectric constant of a typical dielectric transport web 121 lies in a nominal range of approximately 3.0–3.1, although the dielectric constant may have a value higher or lower than this nominal range. The dielectric breakdown strength of TW 121 is usually greater than about 40 volt/micrometer, and more usually, greater than 60 volt/micrometer.

It will be appreciated that quite large amounts of charge can be deposited on the back side 102 of TW 121 (i.e., the side facing rollers 122*a,b*) by action of the tackdown charger 127 and also by the successive electrostatic transferrings of toner images from the ITMs to each receiver passing through the modules. For example, when negative corona charges are applied by tackdown charger 127 to the top surface of a receiver member, a substantially equal number of induced positive charges are deposited by roller 122*a* on the back side of TW 121. Similarly, when negatively charged toner images are subsequently transferred to the receiver member, corresponding positive charges are successively deposited in each module by the transfer rollers, e.g., T1,2,3,4. Thus charges deposited on the back side 102 of TW 121 during transfer are added to charges deposited during tackdown, e.g., by charger 127. As a result of these charges, air breakdown will typically cause a considerable amount of charge to be deposited on the outer surface 101 of the web when a receiver member is removed from TW 121 during mechanical detack (absent a detack charger). It is not unusual for the resulting polar charge on the web to be equivalent to a potential difference across the web in excess of 4000 volts. Evidently, the amount of polar charge and the corresponding voltage produced across TW 121 after detack will in general be larger the greater the number of modules, the greater the charge-to-mass of the toners, or the greater the thicknesses of transferred toner images. In addition to the polar charge, there will also generally be deposited a substantial net charge of about 27 microcoulombs/$m^2$ as imposed by the long-range air breakdown limit in the air around the web.

Figure 2:
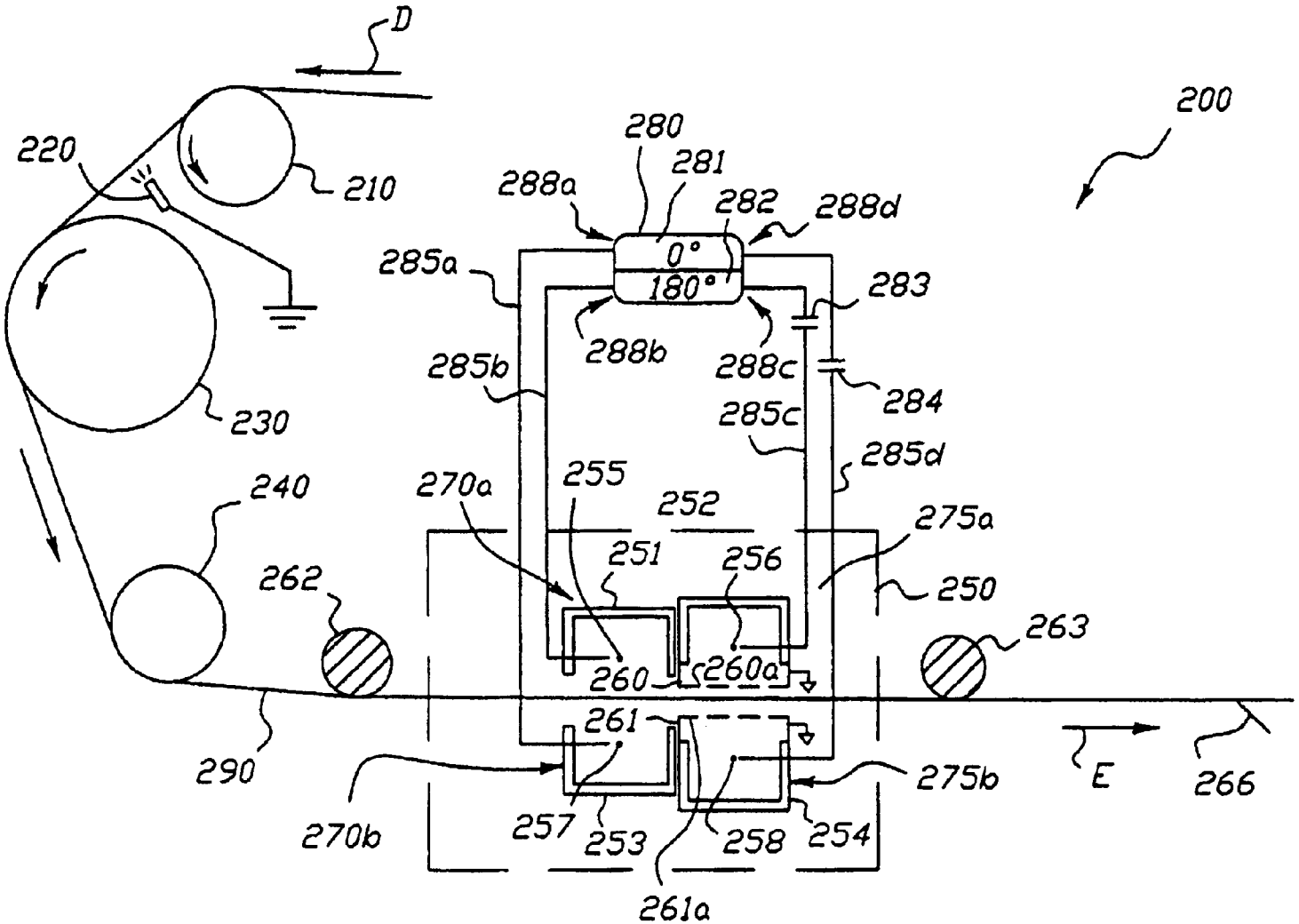
FIG. 2 shows a side elevational drawing (not to scale) illustrating a portion of the printer of FIG. 1, with a transport web passing through a web conditioning charging station having a first stage and a second stage, the first stage including a pair of open wire AC corona chargers facing one another across the transport web, and the second stage including a pair of gridded AC corona chargers facing one another across the transport web, the illustrated portion of the printer also provided with devices including rollers and web-supporting members associated with the transport web.

FIG. 2 shows a side elevational drawing (not to scale) illustrating in more detail a portion of a printer similar to the printer of FIG. 1, which portion is indicated by the numeral 200. A moving transport web 290, having properties as described above for web 121 of FIG. 1, is shown entering a web conditioning charging station (WCCS) 250 of the invention, the WCCS indicated in cross-section and confined within the dashed line. The WCCS 250 (and an associated energizing power unit described below) can be a neutralizer so as to produce an aim value of residual polar charge density having magnitude less than about 13.7 $\mu C/m^2$, which corresponds to a potential difference of about ±50 volts across a transport web having a capacitance of about 0.27 $\mu F/m^2$. Moreover, the WCCS can handle wide variations of polar charge density on the incoming transport web 290. WCCS 250, when acting as a neutralizer, is required to consistently produce a degree of charge neutralization so as to provide a downstream polar charge density on the web less than or equal to the aim value of 13.7 $\mu C/m^2$.

Discharging or neutralizing of the transport web by a web conditioning charging station of the invention is intended to accomplish at least six objectives, namely:

(i) to minimize toner transfer artifacts arising from a nonuniform charge distribution on the transport web;

(ii) to minimize the voltage required for a tackdown charger power supply;

(iii) to minimize the voltage required for transfer power supplies for transferring toner images to receiver members;

(iv) to minimize attraction of dust to the transport web;

(v) to minimize EMI (electromagnetic interference) from electrical dischargers to the transport belt; and (vi) to aid blade cleaning of process control reference patches.

Transport web 290 is typically made of a polyethyleneterephthalate (PET) film approximately 100 $\mu$m thick, the web moved at a typical speed of at least 300 millimeters/sec (11.7 ips), although a lower speed may be used. The WCCS 250 has a first stage and a second stage, the first stage including web charging corona devices or chargers 270*a* and 270*b*, and the second stage including devices 275*a* and 275*b*. In addition to WCCS 250, the illustrated portion 200 of the printer is provided with auxiliary devices including rollers and web-supporting members associated with the transport web 290. Thus the rotating closed loop transport web 290, of which a length is shown, passes in direction of arrow D over a detack roller 210 and then, before entering the WCCS 250, moves as shown in a counterclockwise direction successively past an optional passive discharge brush 220, a roller 230 which is preferably a drive roller, a tensioning roller 240, and a web-supporting member shown as a constraint ski 262. Downstream from WCCS 250 is a web-supporting member shown as a constraint ski 263. In the direction of arrow E is located a web cleaning device or web cleaner such as a blade cleaner 266 for cleaning the outer face of web 290.

The first stage of WCCS 250 has two opposed open-wire (no grid) first-stage AC corona chargers facing one another on both sides of the transport web 290. Inner open-wire charger 270*a* which faces the inner or back side of the web includes a dielectric shell 251 and a tensioned first-stage corona wire 255. Alternatively, first-stage charger 270*a* may optionally include more than one corona wire. Corona wire 255 is preferably made of tungsten. The wire 255 may be gold-plated. Wire 255 has a diameter preferably in a range of approximately between 0.0015 inch and 0.0050 inch, and more preferably about 0.0033 inch. The wire 255 is located at an inner first-stage spacing from the inner side of the web 290. As shown, shell 251 includes a back wall and two sidewalls preferably forming three sides of a hollow shape having substantially planar interior surfaces, which interior surfaces form three sides of a rectangle partially enclosing corona wire 255. However, shell 251 may have any suitable hollow shape. The shell 251 can be made of any suitable insulating material, preferably of a polymeric material or of a plastic which may be reinforced by included fibers. Preferably, shell 251 is made of a modified polysulfone including 30% chopped glass fibers, sold under the trade name Mindel B-430. Outer open-wire charger 270*b*, which first-stage charger faces the outer or front side of web 290, includes a dielectric shell 253 made of any suitable insulating material, and a first-stage corona wire 257 made of any suitable material located at an outer first-stage spacing from the outer side of web 290. The corona charger 270*b* is preferably substantially the same as charger 270*a*, i.e., in components, in materials, in shape, and in dimensions (within manufacturing tolerances).

The second stage of WCCS 250 has two opposed, gridded, second-stage AC corona chargers facing one another on both sides of the transport web 290. Inner gridded charger 275*a* includes a dielectric shell 252 made of any suitable insulating material and preferably having the same dimensions and shape and made of the same material as shell 251, and a second-stage tensioned corona wire 256 made of any suitable material with corona wire 256 being preferably entirely similar to wire 255. Alternatively, second-stage charger 275*a* may optionally include more than one corona wire. A conductive preferably metallic grid member 260 is disposed as shown to partially enclose charger 275*a*, which grid member includes a grid 260*a* of any suitable pattern, shape or transparency located at an inner grid spacing from the inner side of the web 290. For example, the grid 260*a* may have a pattern in the form of a mesh, or may have a pattern in the form of parallel stringers. The grid member 260 preferably has solid sidewalls, as indicated in FIG. 2. However, the sidewalls may include multiple openings, which openings may form a mesh pattern. Outer gridded charger 275*b* includes shell 254 made of any suitable insulating material, corona wire 258 made of any suitable material, and conductive grid member 261 which is entirely similar to grid member 260, with the grid 261*a* of grid member 261 located at an outer grid spacing from web 290. Grid members 260 and 261 are preferably grounded, although a DC potential may be applied to either of the grid members. Preferably, second-stage charger 275*b* is substantially the same in components, in materials, in shape, and in dimensions (within manufacturing tolerances) as charger 275*a*. The grids 260*a* and 261*a* included in grid members 260 and 261 in WCCS 250 are preferably mounted substantially parallel to one another and directly opposite one another, although other positionings of the grids can be used as may be suitable. Moreover, wires 255 and 257 are preferably mounted substantially parallel to each another and preferably so as to directly oppose one another across web 290, such as illustrated for wires 256 and 258, although other mountings of the wires can be used as may be suitable.

It is preferred that shells 251, 252, 253, and 254 are substantially the same as one another, and also that corona wires 255, 256, 257 and 258 are substantially the same as one another. Furthermore, it is preferred that chargers 275*a,b* differ from chargers 270*a,b* only by the additional mountings of the respective grid members 260 and 261. The grid members 260 and 261 are preferably substantially the same as one another, with grid members 260 and 261 being preferably readily demountable from the respective shells 252 and 254, e.g., for purpose of replacement or for charger servicing. Moreover, it is preferred that each of the chargers 270*a,b* and 275*a,b* is readily removable from WCCS 250, e.g., for purpose of replacement or servicing.

Web 290 slides, preferably under tension, over upstream constraint ski 262 and downstream constraint ski 263 as the web is driven through WCCS 250, e.g., by roller 230. Preferably, the ski members 262 and 263 are cylindrical in cross-section with each ski having a preferred diameter of approximately 0.5 inch. Typically, constraint ski 262 is located at a distance several centimeters away from the upstream edge of shell 251, with constraint ski 262 being about the same distance away from the downstream edge of shell 252. However, these distances are not critical. It is preferred that the web-supporting members in the form of constraint skis 262 and 263 are non-rotatable and made of highly polished stainless steel. However, the web-supporting members may be rotatable, can have any suitable shape and dimensions, and can be made from any suitable material. It is preferred that any surface of a web-supporting member over which contacting web 290 slides has a surface roughness of less than about 8 microinch.

In the printer portion 200, web-supporting members 262 and 263 are shown optionally located outside of WCCS 250. In a preferred embodiment, described below with reference to FIGS. 5A,B,C, constraint ski members entirely similar to ski members 262 and 263 are incorporated within the web conditioning charging station such that the ski members and the four chargers similar to chargers 270*a,b* and 275*a,b* are all mounted in a supporting structure provided in common, with one ski member located near the entrance of the web conditioning charging station and the other near the exit.

Corona wires 255, 256, 257, and 258 are energized by a high voltage power unit 280 having four regulated separately controllable outputs, namely 288*a*, 288*b*, 288*c*, and 288*d*AC outputs 288*a,b,c,d* respectively activate corona wires 257, 255, 256, and 258 using respective shielded high voltage lines 285*a,b,c,d*. A coupling capacitance in the form of a combination capacitance 283 may be inserted as shown in line 285*c*, and a coupling capacitance in the form of a combination capacitance 284 similarly inserted in line 285*d*. The coupling capacitors block DC current and thus the total emission from each corona wire is forced to have equal time-averaged positive and negative emission currents. Coupling capacitance 283 may for example include two preferably polyester film capacitors connected in series, and similarly for coupling capacitance 284.

Although the separate regulation of the four outputs 288*a,b,c,d* increases the cost of the power unit 280, this increased cost is more than balanced by lower costs for the charger support elements (see below) and for the plastic charger bodies (identical for all the charging units).

Preferably, corona wire 255 is situated at a distance of approximately between 8 mm–12 mm away from the back inner surface of shield 251. More preferably, corona wire 255 is situated at a distance of about 10 mm from this back inner surface, which back inner surface is approximately parallel to web 290. It is further preferred that the corona wire 255 be substantially parallel with the inner surfaces of shield 251, and symmetrically situated with respect to the inner surfaces of the two side walls of shield 251, as indicated in FIG. 2, with corona wire 255 being preferably located approximately at a perpendicular (i.e., closest) distance of approximately between 8 mm–12 mm from the inner surface of each side wall, and more preferably approximately between about 9 mm–10 mm. It is preferred that the disposition of corona wire 257 within shell 253 is substantially the same as the disposition of corona wire 255 within shell 251, i.e., having the same geometry and dimensions. A preferred distance between the preferably parallel corona wires 255 and 257 is approximately between 8 mm and 16 mm, and a more preferred distance is approximately 11.2±1.5 mm. It is further preferred that the distance between the preferably parallel corona wires 255 and 257 be fixed and nonadjustable, e.g., for reasons of lower manufacturing and service costs. However, a spacing adjusting mechanism (see FIG. 10) may be used to make this inter-wire distance adjustable, by for example providing parallel movement of at least one of the chargers 270*a* and 270*b* relative to one another, e.g., during operation of the printer. In certain cases, web 290 is symmetrically disposed between wires 255 and 257. However, a preselected first-stage asymmetry is preferably present. First-stage asymmetry is a dimensionless number, defined as: ((the perpendicular distance between wire 255 and web 290) minus (the perpendicular distance between wire 257 and web 290)) divided by (the perpendicular distance between wire 255 and wire 257). It will be evident that first-stage asymmetry can have positive or negative values. Preferably, the absolute value of the perpendicular distance between wire 255 and web 290 minus the perpendicular distance between wire 257 and web 290 is less than or equal to about 5.1 mm, and more preferably, less than or equal to about 3.6 mm. As described above, the upstream polar charge density on the web 290 is generally large, and this polar charge density is typically reduced to a (much) lower value downstream of WCCS 250. When the polarity of the outer face of the web upstream of WCCS 250 is negative, a positive value of first-stage asymmetry is preferred, with a preselected first-stage asymmetry having a value preferably in a range between approximately 0.14 and 0.64, and more preferably, 0.14 and 0.37. Conversely, when the upstream polarity of the outer face of web 290 is positive, a negative value of first-stage asymmetry is preferred, with a preselected first-stage asymmetry having a value preferably in a range between approximately −0.14 and −0.64, and more preferably, −0.14 and −0.37. The first-stage asymmetry is preferably the same anywhere along the operational lengths of the corona wires, and the above limits on preselected first-stage asymmetry include any operational non-flatness of the web 290, e.g., as may be due to web curl or flutter (both of which are preferably minimized). However, any useful value of first-stage asymmetry can be employed in the operation of WCCS 250. Moreover, because the first stage chargers 270*a* and 270*b* typically have different charging efficiencies, a compensating first-stage asymmetry can be provided for purpose of equalizing the charging currents of the first stage chargers.

In the second stage, it is preferred that the dispositions of wires 256 and 258 within the respective shells 252 and 254 are substantially the same as the disposition of wire 255 in shell 251, i.e., having the same geometry and dimensions. The substantially parallel grids 260*a* and 261*a* of grid members 260 and 261 are preferably separated by a distance in a range between approximately 2 mm-5 mm, and more preferably, 3.0 mm±0.5 mm. It is further preferred that the distance between the grids 260*a* and 261*a* of grid members 260 and 261 be fixed and nonadjustable, e.g., for reasons of lower manufacturing and service costs. However, a mechanism (not illustrated) may be employed as may be necessary to make this inter-grid distance adjustable, such as for example by moving chargers 275*a* and 275*b* parallel to one another, e.g., during operation of the printer. In charger 275*a*, it is preferable that a closest distance between wire 256 and the grid 261*a* is in an approximate range between 8 mm–12 mm, and more preferably 10.0 mm±0.5 mm, and similarly for the distance between wire 258 and the grid 261*a* of charger 275*b*. In certain cases, web 290 is symmetrically disposed between grid members 260 and 261. However, a preselected second-stage asymmetry is preferably present. Second-stage asymmetry is defined as: ((the perpendicular distance between grid 260*a* and web 290) minus (the perpendicular distance between grid 261*a* and web 290)) divided by (the perpendicular distance between grid 260*a* and grid 261*a*). Preferably, the absolute value of the perpendicular distance between the grid 261*a* and web 290 minus the perpendicular distance between the grid 260*a* and web 290 is less than or equal to 1.5 mm. It will be evident that second-stage asymmetry can have positive or negative values. A preferred preselected value of second-stage asymmetry (anywhere along the length of the grids) is approximately 0.00±0.75, and more preferably approximately 0.00±0.50. The second-stage asymmetry includes any operational non-flatness of the web 290, e.g., as may be due to web curl or flutter (both of which are preferably minimized). However, any useful value of second-stage asymmetry can be employed in the operation of WCCS 250. Moreover, because the second stage chargers 275*a* and 275*b* typically have different charging efficiencies, a compensating second-stage asymmetry can be provided for purpose of equalizing the charging currents of the second stage chargers.

Although it is preferred that corona wires and 255 and 257 be directly opposed, a certain misalignment of these first stage wires can be tolerated, which misalignment is measured in the in-track direction, i.e., parallel to the direction of arrow E. The first stage in-track misalignment is preferably less than about ±1 mm. Similarly, a second stage in-track misalignment can be tolerated which is preferably less than about ±1 mm.

The power unit 280 is divided into two power subunits, 281 and 282. Output 288*a* provides an outer first-stage AC voltage waveform, output 288*b* provides an inner first-stage AC voltage waveform, output 288*c* provides an inner second-stage AC voltage waveform, and output 288*d* provides an outer first-stage AC voltage waveform. Preferably, the AC voltage waveforms from outputs 288*a* and 288*d* of power subunit 281 are in phase with one another, although the phase difference between these waveforms may be non-zero in certain applications. The AC voltage waveforms from outputs 288*b* and 288*c* of power subunit 282 preferably have the same phase difference as that between outputs 288*a* and 288*d*. On the other hand, the AC voltage waveforms from outputs 288*a* and 288*b* are preferably mutually 180° out of phase (although the phase difference between these waveforms may be different from 180° in certain applications). Similarly the AC voltage waveforms from outputs 288*c* and 288*d* are preferably mutually 180° out of phase (although the phase difference between these waveforms may be may be different from 180° in certain applications). Thus, with outputs 288*a* and 288*b* both having for example a phase angle of 0° as indicated in FIG. 2, the outputs 288*c* and 288*d* would preferably have a phase angle of 180° as is also indicated in FIG. 2.

It is preferred that the AC voltage waveforms from each of the outputs 288*a,b,c,d* is quasi-trapezoidal with zero DC offset. By "quasi-trapezoidal" it is meant that a voltage cycle is symmetric about zero volts and begins, for example, with a rapid, quasi-linear rise of positive voltage, the positive voltage leveling off (after any possible overshoot) to a plateau or peak voltage and remaining approximately at peak for the majority of the time of the first half-cycle; near the end of the first half-cycle, the voltage falls from the peak positive voltage at substantially the same rate and with the same functional variation with time as did the initial rise starting at the beginning of the first half-cycle. In the second half-cycle, the voltage becomes negative and has a variation with time such that the amplitude of the negative half-cycle varies substantially similarly to that of the first half-cycle. For each of the outputs 28*a,b,c,d*, it is preferred that a maximum peak-to-peak voltage is about 15 KV (not including any voltage overshoots above steady peak voltages) and a minimum peak-to-peak voltage is about 8 KV. It is more preferred that the peak-to-peak voltage is in a range of approximately between 11 KV-12 KV. The peak-to-peak voltages of the voltage waveforms applied to wires 255 and 257 are preferably substantially equal to one another. Similarly, the peak-to-peak voltages applied to wires 256 and 258 are preferably substantially equal to one another. The frequency of each voltage waveform is preferably less than about 1000 Hz, and more preferably, lies within a range of approximately between 280 Hz–600 Hz. Most preferably, the frequency is about 400 Hz±20 Hz.

For excitation frequencies below about 600 Hz, it is preferred that each of the voltage waveforms from the outputs 288*a,b,c,d*, has a similar risetime (defined here as the time between 10% and 90% of the peak voltage of each half-cycle, starting from substantially zero volts) which is preferably in a range of approximately between 75 $\mu$s and 275 $\mu$s, and more preferably between 200 $\mu$s and 250 $\mu$s. A corresponding similar falltime for each waveform (time from 90% to 10%) is preferably substantially the same as the risetime. For frequencies of about 600 Hz and above, it is preferred that risetimes and falltimes are reduced from the above values in a manner inversely proportional to frequency. Thus, if $\tau$ is a given risetime or falltime for frequencies lower than 600 Hz, then for any frequency $\phi$ greater than 600 Hz, a given risetime or falltime is preferably equal to $(600\tau/\phi)$. For example, for an operationally useful risetime or falltime of say $\tau$=200 $\mu$s at frequencies below 600 Hz, a corresponding risetime at say $\phi$=800 Hz would be preferred to be (600×200/800)=150 $\mu$s.

It is preferred that the excitation frequencies of the first stage chargers 270*a,b* are the same and also equal to the excitation frequencies of the second stage chargers 275*a,b*. In an alternative embodiment, the frequencies of the voltage waveforms from outputs 288*a* and 288*b* are equal to a first-stage frequency, and the frequencies from outputs 288*c* and 288*d* are equal to a second-stage frequency, the first-stage and second-stage frequencies being generally different from one another.

Advantageously, the preferred quasi-trapezoidal voltage waveforms for use in WCCS 250 are more efficient for producing corona currents than are sinusoidal voltage waveforms. However, any suitable AC voltage waveforms may be produced at outputs 288*a,b,c,d* and moreover, each such waveform can include a non-zero DC offset potential, and each such waveform can have any suitable frequency and phase.

Using the most preferred frequency of about 400 Hz±20 Hz, each of the coupling capacitances 283 and 284 preferably has a capacitance in a range of approximately between 0.005 μF-0.5 μF, and more preferably, 0.05 μF-0.15 μF with a rating of preferably about 200V or greater. Most preferably, and specifically when the output impedance of each of power subunits 288*c* and 288*d* is about 5 megohms, each of the coupling capacitances 283 and 284 has a capacitance of about 0.08 μF and a rating of about 630V or greater. However, any suitable disposition of suitably rated capacitors may be inserted in each of lines 285*c* and 285*d*. Any combination of capacitors can be used, which combination capacitance can include capacitors connected in parallel and in series, with the combination capacitance preferably in a range of approximately between 0.005 μF–0.5 μF, and more preferably, between 0.05 μF-0.15 μF (at about 400 Hz±20 Hz).

In general, the combination capacitance per output is frequency dependent. The following expression may be used to estimate an approximate value of a minimum effective combination capacitance, $C_{min}$, for use with each of the outputs 288*c* and 288*d*:

$$C_{min}=(2p\alpha fR)^{-1}$$

where f is the frequency of the quasi-trapezoidal second stage voltage waveform, R is the output impedance of each of power subunits 281 and 282, and α is a factor which assures that the impedance $(2pfC_{min})^{-1}$ of the combination capacitance is very much smaller than R. A value of α of about $10^{-3}$ is generally suitable. For the sake of example, if R=5 megohms, α=0.001, and f=400 Hz, the corresponding computed estimate of $C_{min}$ is 0.080 μF, and therefore any suitable capacitance larger than approximately 0.080 μF can suitably be used for these particular values of R, α, and f. In view of the uncertainty associated with the above estimate of α, it will be appreciated that a calculated estimate of $C_{min}$, is only a rough guide, and that confirming experiments are to be carried out to determine useful values of minimum effective combination capacitance.

The optional passive discharge brush 220 has a purpose of removing net charge and converting all charge on the web to polar charge. It is preferred that the power output of power unit 280 be large enough so that the use of an element such as passive discharge brush 220 has little or negligible effect on the operation of WCCS 250, thereby allowing the discharge brush to be advantageously omitted from the printer.

With reference to FIG. 2, the web cleaner such as for example blade 266 located downstream from WCCS 250 in direction of arrow E is for cleaning the outer surface of the transport web 290 (the web cleaner can be any suitable cleaning device including a blade, a brush, a magnetic brush, and so forth). The primary function of this cleaner is to act as a reference patch cleaning device for removing toner particles from reference test patches (reference test patches described earlier above). A secondary function of the web cleaner is to remove adventitious dirt particles or fibers from the outer surface of web 290. The toner particles in the reference test patches are neutralized by the WCCS 250 so as to make them readily removable by the web cleaner, which web cleaner is preferably a blade. However, the web cleaner may be any other suitable cleaning device, e.g., a brush or a cleaning web, and so forth.

As shown in the embodiment of FIG. 2, the first and second stages of the WCCS 250 are mounted adjacently and in close proximity to one another, preferably on a supporting structure provided in common. The first and second stages are separated by any suitable spacing, which suitable spacing is preferably between zero and about 2 cm. Moreover, the spacing between shells 251 and 252 is preferably substantially the same as the spacing between shells 253 and 254, with shell 251 preferably directly opposite shell 253 and shell 252 preferably directly opposite shell 254.

Figure 10:
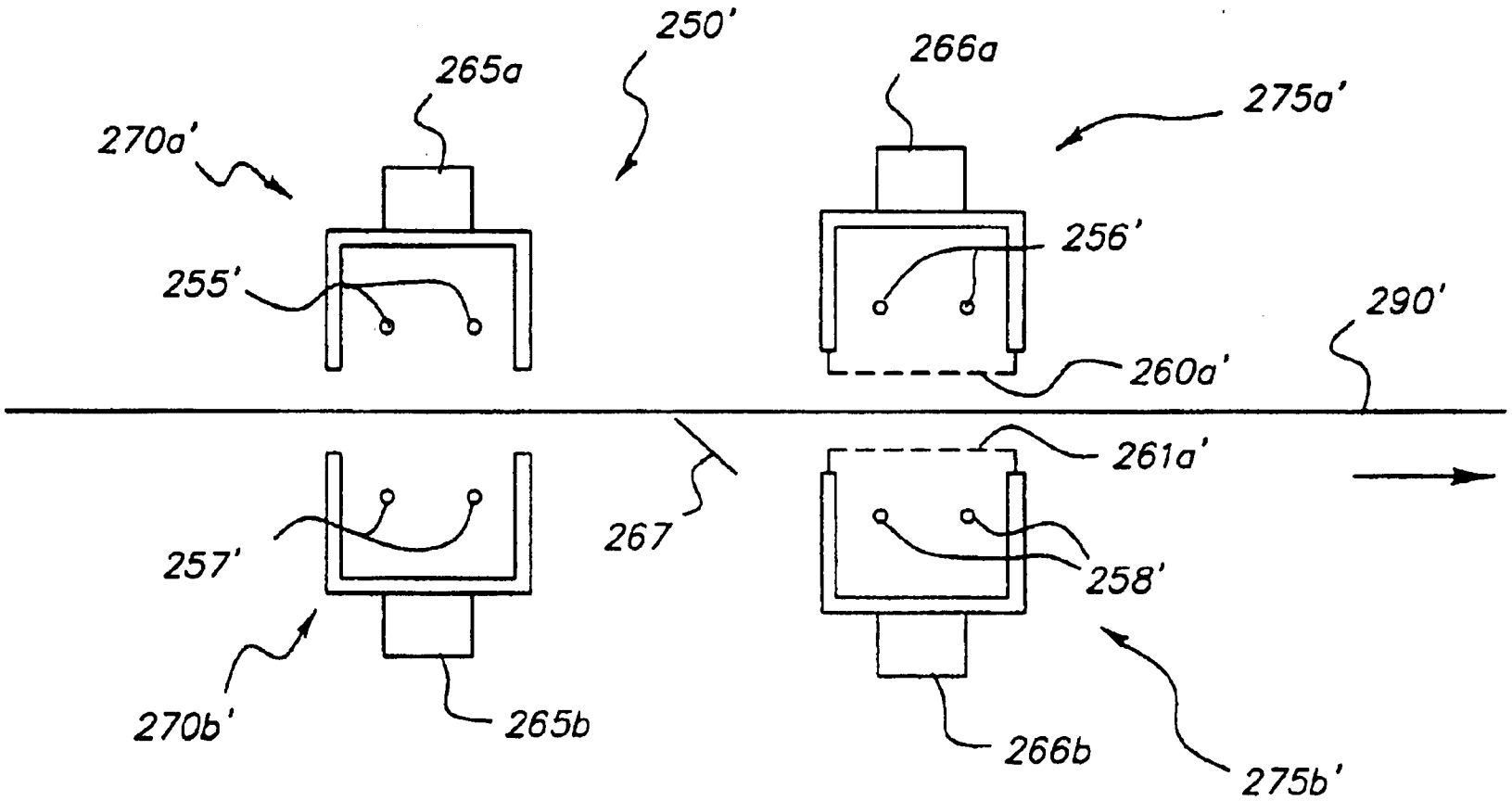
FIG. 10 shows a side elevational drawing (not to scale) illustrating a web conditioning charging station for conditioning a transport web, a first stage including a pair of dual-wire open wire AC corona chargers facing one another across the transport web, and a second stage including a pair of gridded dual-wire AC corona chargers facing one another across the transport web, each charger shown with an optional spacing adjusting mechanism, and with a web cleaning station located between the first and second stages.

In an alternative embodiment, shown as 250' in FIG. 10, the primed entities correspond to the similarly numbered entities of FIG. 2. In embodiment 250', the first and second stages are physically separated from one another by a distance along the direction of travel of the transport web, with a web cleaning device such as blade 267 mounted between the first and second stages, and with suitable gaps provided between the first-stage chargers and the web cleaning device and between the web cleaning device and the second-stage chargers. The first-stage chargers preferably produce a preselected voltage polarity and a preselected potential difference across the transport web, so as to provide suitable first-stage conditioning of the web prior to entry of the web into the web cleaning device. The web conditioning charging station in this alternative embodiment includes, in the first stage, a pair of ungridded open wire AC chargers 270*a'* and 270*b'* operating similarly to chargers 270*a* and 270*b* respectively, i.e., 180 degrees out of phase with one another, and in the second stage, a pair of gridded AC chargers 275*a'* and 275*b'* and operating similarly to chargers 275*a* and 275*b* respectively, i.e., 180 degrees out of phase with one another. Similar spacings are used between chargers and transport web 290' as for embodiment 200, with the excitation waveforms of both front side chargers (or back side chargers) being quasi-trapezoidal, mutually in phase, and preferably having 400 Hz frequency. In this alternative embodiment 250', the first-stage chargers are supported by any suitable first-stage supporting structure, and the second-stage chargers are supported by any suitable second-stage supporting structure. Moreover, the chargers 270*a'*, 270*b'*, 275*a'* and 275*b'* may be optionally provided with more than one corona wire, such as for example the dual-wire chargers illustrated in FIG. 10. In addition, each of the chargers 270*a'*, 270*b'*, 275*a'* and 275*b'* may be optionally provided with a spacing adjusting mechanism respectively indicated as 265*a*, 265*b*, 266*a* and 266*b*, which spacing adjusting mechanism is for moving one or more chargers individually or in combination, by any suitable mechanism, toward or away from web 190'.

As stated above, it is preferred not to employ a detack charger in printer 100 and printer portion 200. When no detack charger is used, the amounts of charge on the transport web arriving at the web conditioning charging station (WCCS) are generally considerably larger than they would be had a detack charger in fact been used. Hence, the performance requirements of the WCCS need to be correspondingly higher, and a preferred embodiment of the WCCS (without use of a detack charger) therefore requires more expensive AC power supplies with higher power consumption and higher reliability. On the other hand, when a detack charger is used, it may be disadvantageously necessary to alter the spacing between the detack charger and the transport web in order to efficiently detack different types of receiver members, e.g., to detack receiver members having different thicknesses or having different resistivities or dielectric constants. Also, when using a detack charger in conjunction with thick receiver members, there is a disadvantageous propensity to damage unfused toner images by image disruptions induced by the detack charger, which image disruptions can include dot explosions, streaks, and Lichtenberg figures from static surface discharges. Therefore, by not using a detack charger, as is preferred, there is inherently some reliability improvement for the printer, and there are also manufacturing and service cost savings which mitigate extra expense for the web conditioning charging station.

The inventive second stage charger of the web conditioning charging station has several functions:

(a) the function of correcting for manufacturing tolerance errors, not only of the first stage chargers, but also of the associated parts of the entire printing machine (inclusive of the web itself) which can affect the charging of the web;

(b) the function of compensating for performance loss of the first stage chargers caused by aging of charger components, e.g., aging of the corona wires;

(c) the important function of web neutralization, i.e., of driving the voltage across the transport web to approximately zero (due to the grounded grids and the coupling capacitors);

(d) the important function, for high quality printing, of providing a uniformly neutralized web, i.e., providing smoothing of voltage nonuniformity on the front and back faces of the transport web (see Example 4 below);

(e) the important function of providing robust performance of the web conditioning charging station with respect to a different levels of polar charge density on the incoming web entering the web conditioning charging station.

It is preferred that the operating setpoints of the first stage of the web conditioning charging station are set so as to ensure that the first stage provides a large percentage of the neutralization function. Preferably, this large percentage is at least about 80% of the neutralization of the incoming polar charge density on the web.

Referring again to FIG. 2, the voltage waveforms from the four regulated separately controllable outputs 288*a*, 288*b*, 288*c*, and 288*d* may be controlled for example by using a web-voltage-measuring device including for example an electrostatic probe to measure a time-averaged voltage on the transport web 290 (or alternatively, an rms voltage on the web) after the web has moved downstream from the WCCS 250. The output of the web-voltage-measuring device can be sent to a computer with feedback control function, the computer programmed so as to adjust the amplitudes of the individual AC voltage waveforms, e.g., the peak voltages. The computer may alternatively be programmed so as to adjust one or both of any first-stage DC offsets. With this type of control, the magnitude of the time-averaged voltage (or rms voltage) on the transport web can be maintained at a magnitude less than or equal to a predetermined magnitude. However, this type of control, although able to compensate for aging of the corona wires and for variable ambient conditions (such as air pressure, relative humidity, and temperature) is complicated and costly. Moreover, use of a web-voltage-measuring device introduces an extra system element which disadvantageously increases any inherent printer unreliability.

In a preferred embodiment, the voltage waveforms from the four regulated separately controllable outputs 288*a*, 288*b*, 288*c*, and 288*d* are controlled within the power unit 280, the power unit maintaining, for each of the current waveforms emanating respectively from the separately controllable outputs 288*a*, 288*b*, 288*c*, and 288*d*, a characteristic value of current associated with each respective current waveform. Thus, the power unit 280, using an internal computer, compares an operational value of this characteristic value of current with a pre-set value, and via feedback adjusts one or more of the respective voltage waveforms so that the operational value and the pre-set value are kept substantially the same in each cycle (or over a number of cycles). As is well known, when an output voltage is changing with time, there is a displacement current associated with capacitance in the output circuit, which displacement current is not included in the real current emanating from the corresponding corona wire, and which displacement current can be large during a rapid risetime of the voltage waveform. Therefore, if a real current is measured at some designated fraction of an AC cycle and used as the characteristic value of current (for comparison in power unit 280 with a pre-set value of this current) it is desirable for this current to be stable and independent of the displacement current. This is not very practical, inasmuch as during each half cycle the dielectric shells 251, 252, 253 and 254 tend to charge up, thereby tending to suppress corona emission which can be a cause for the emission currents from the respective corona wires to decline with time, e.g., even when the corona excitation voltage is relatively constant and near peak value. In the preferred embodiment, the operational root mean square (rms) current, measured over at least one complete period or cycle and inclusive of both emission and displacement currents, is used as the characteristic operational value of current, i.e., for comparison in power unit 280 with a pre-set value of rms current. Moreover, a pre-set value of rms current for each of the outputs 288*a*, 288*b*, 288*c*, and 288*d* is preferably dialed in to the power unit 280, e.g., by an operator of the printer. Although a measured rms current includes the displacement currents during each cycle, it should be noted that when the voltage polarity changes at the beginning of each half-cycle, the emission currents are temporarily enhanced owing to the electrostatic charges of opposite sign stored during the previous half-cycle on the inner walls of the shells 251, 252, 253 and 254, thereby contributing substantial extra (non-displacement) currents during the risetimes of the corresponding preferably quasi-trapezoidal voltage waveforms. In order to minimize the contributions from displacement currents to the measured rms currents, it is preferable to use AC frequencies at the lower end of the preferred range of frequencies. A frequency in common of about 400 Hz is preferred for all of the outputs 288*a*, 288*b*, 288*c*, and 288*d*.

Preferably the first-stage corona wires 255, 257 and the second-stage corona wires 256, 258 have similar lengths. In order to normalize for corona wires which may have different lengths, e.g., in various modifications of the printer, the nms currents from the outputs 288*a,b,c,d* are divided by the lengths of the corresponding corona wire(s). Thus, rms current per unit length of corona wire is preferably specified, e.g., in milliard/meter (ma/m).

An nms current per unit length of corona wire from each of the first-stage outputs 288*a,b* preferably lies in a range of approximately between 1.1 ma/m and 3.3 ma/m at a frequency of 400 Hz, and more preferably, is about 1.91±0.14 ma/m. At a frequency of 400 Hz, an rms current per unit length of corona wire from each of the second-stage outputs 288*c,d* preferably lies in a range of approximately between 1.1 ma/m and 3.3 ma/m, and more preferably, is about 1.69±0.14 ma/m.

Figure 3A:
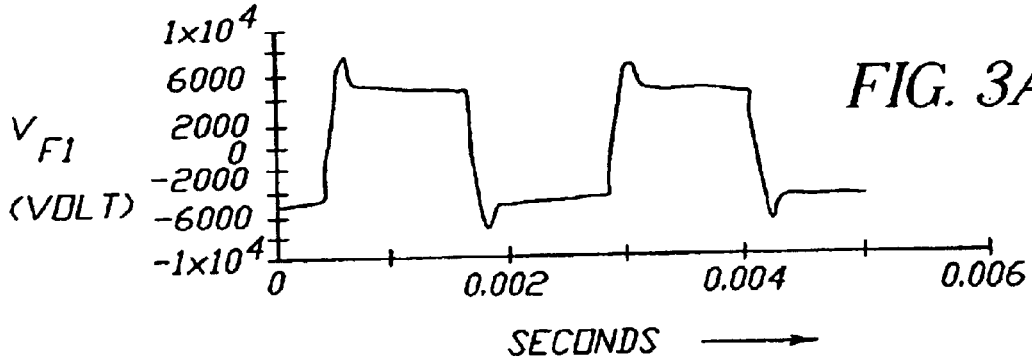
FIGS. 3A,B,C,D respectively show typical operational AC voltage waveforms applied to the corona wires of the first and second stage corona chargers.
Figure 3B:
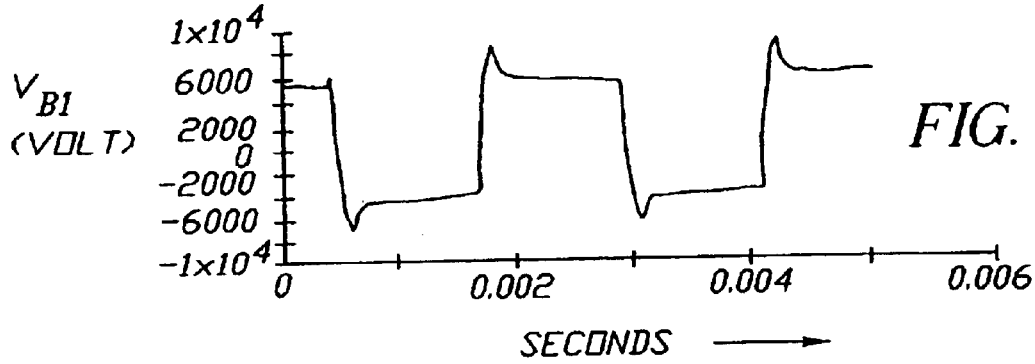
Figure 3C:
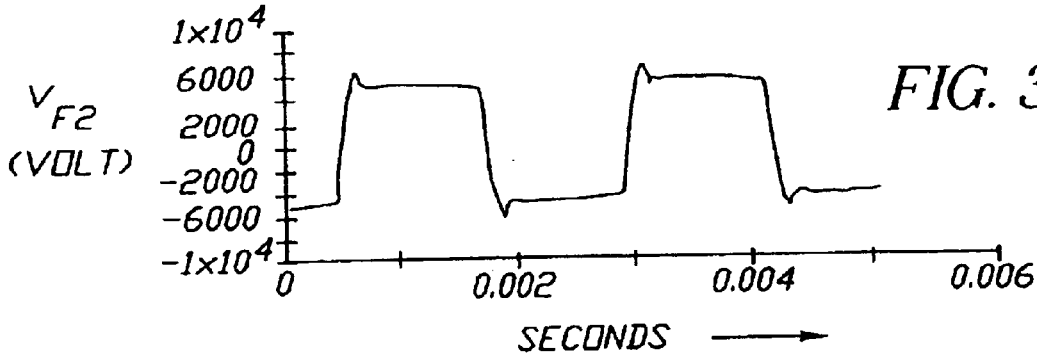
Figure 3D:
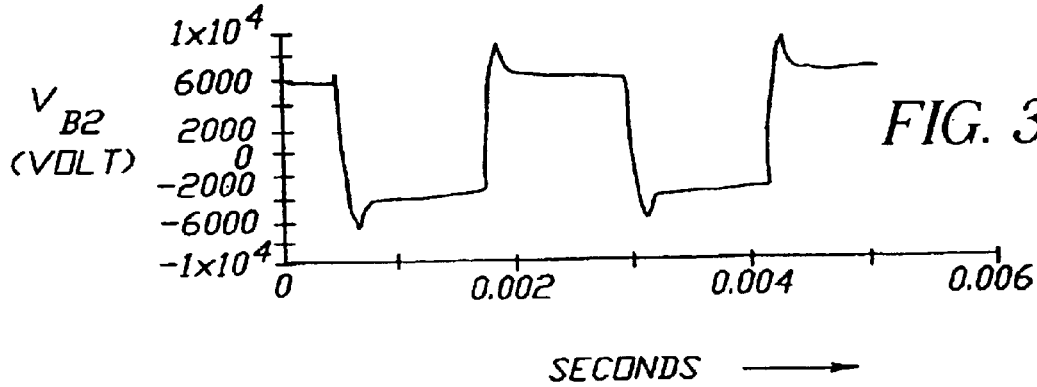

In FIGS. 3A,B,C,D are illustrated typical, experimentally recorded, AC voltage waveforms applied to the corona wires in a preferred embodiment of the invention, in which the chargers of the first and second stages were in all respects similar to chargers 270*a,b* and 275*a,b*. The web conditioning charging station which was used was similar to that shown in FIG. 2 and was included in an operating printer similar to printer 100 of FIG. 1. The transport web (100 $\mu$m thick PET) was moved at 300 mm/sec. The wire-to-wire separation in the first stage, e.g., between wires 255 and 257, was substantially 11.2 mm with no applied asymmetry, and the grid-to-grid spacing in the second stage, e.g., between grids 260*a* and 261*a*, was substantially 3.0 mm with no applied asymmetry. The voltages applied to the corona wires of the web conditioning charging station 250 were automatically adjusted by power unit 280 so as to provide pre-set nms currents to each corona wire, as described above. FIGS. 3A,B show recordings of voltage (volts) versus time (seconds) of first stage voltage waveforms applied respectively to corona wires 257 and 255 (from outputs 288*a* and 288*b*, respectively). $V_{F1}$ is the voltage applied to wire 257 of the front or outer first stage charger 270*b*, and $V_{B1}$ is the voltage applied to wire 255 of the back or inner first stage charger 270*a*. Similarly, FIGS. 3C,D show voltage versus time records for the second stage, where $V_{F2}$ is the voltage applied from output 288*d* to wire 258 of the front or outer second stage charger 275*b*, and $V_{B2}$ is the voltage applied from output 288*c* to wire 256 of the back or inner second stage charger 275*a*. In this test, with substantially the same rms emission currents nominally provided from each of the first stage outputs, the root mean square (rms) value of $V_{F1}$ was 5,115 volts and the rms value of $V_{B1}$ was 5,334 volts. The small difference between these rms voltages can be ascribed to various causes, such as for example the existence of slight differences between the diameters or positionings of the corona wires in the first-stage chargers, or perhaps some small first stage asymmetry in the first stage, e.g., due to tolerancing errors. The rms value of $V_{F2}$ was 5,268 volts, and the rms value of $V_{B2}$ was 5,412 volts, with the rms voltage from the inner second stage charger being higher than that from the outer second stage charger (probably for the same reason as for the first stage charger). As noted earlier above, the voltages applied to the second stage corona wires may differ from the voltages applied to the first stage wires, and in the present instance, the second stage rms voltages were a little higher than the first stage rms voltages, as determined by the pre-set rms current requirements for these test measurements. Note that in each voltage trace of FIGS. 3A,B,C,D, there is a significant voltage overshoot in the quasi-trapezoidal voltage waveforms (both half-cycles). These voltage overshoots are not considered to have any deleterious effect on the operation of the web conditioning charging station at the present AC frequency (400 Hz).

Figure 4A:
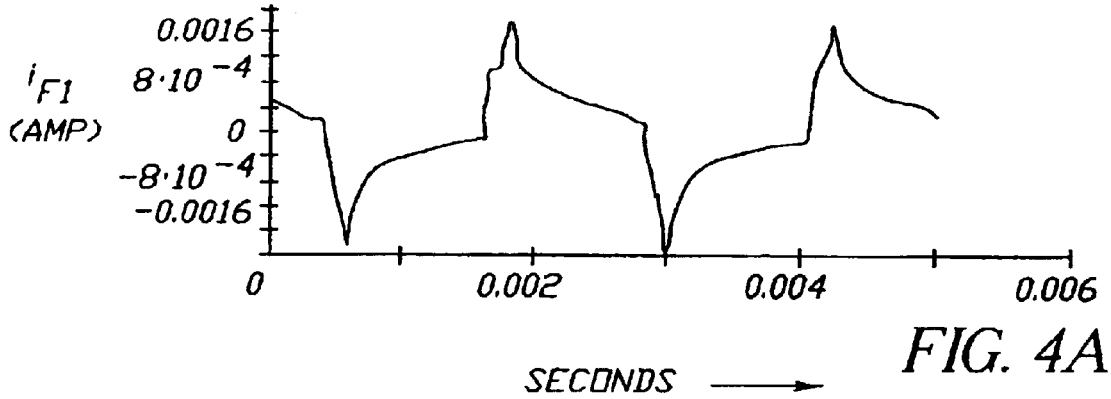
FIGS. 4A,B,C,D respectively show typical operational AC current waveforms associated with corona wire emissions from the first and second stage corona chargers.
Figure 4B:
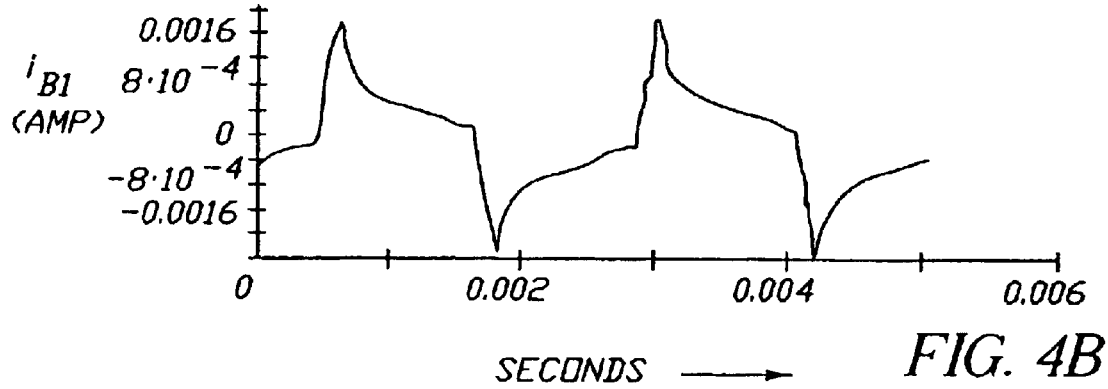
Figure 4C:
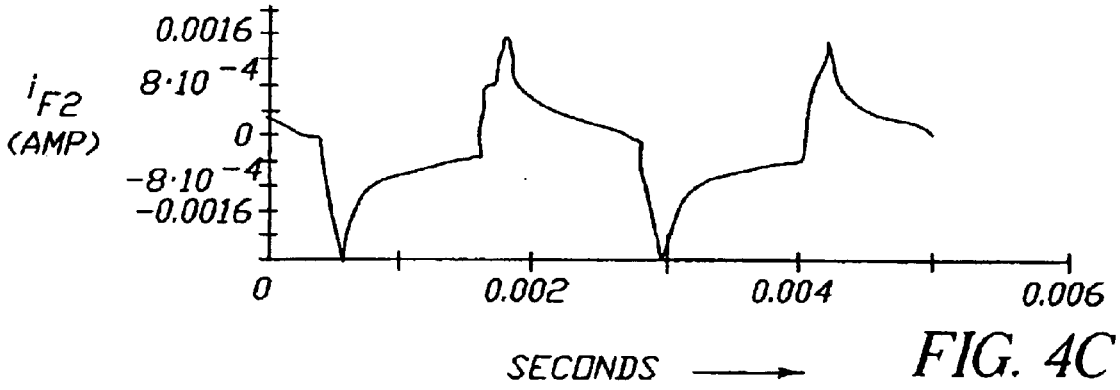
Figure 4D:
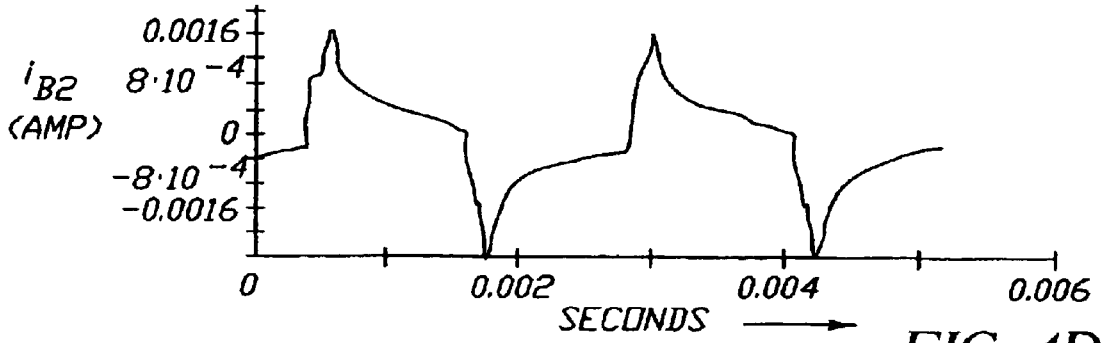

FIGS. 4A,B,C,D show recorded current waveforms corresponding to the voltage waveforms of FIGS. 3A,B,C,D, with currents (amp) measured as a function of time (seconds). Thus, the currents $iF_1$, $iB_1$, $iF_2$, and $iB_2$ respectively correspond to the voltages $VF_1$, $VB_1$, $VF_2$, and $VB_2$, and each of these current waveforms includes the total emission current from the respective corona wire as well as any displacement currents, as described above. In these tests, each of the first-stage and second-stage corona wires was 366.5 mm in length. In each half-cycle the magnitude of the current rises to a peak and then declines, the decline at least partially caused by electrostatic charging of the respective charger shells, as described above. The measured rms currents for the first stage were $iF_1$(rms)=0.718 ma, $iB_1$(rms)=0.718 ma, which agree. For the second stage, $iF_2$(rms)=0.648 ma, $iB_2$(rms)=0.639 ma, which also agree within the experimental error of approximately 1%.

Figure 5A:
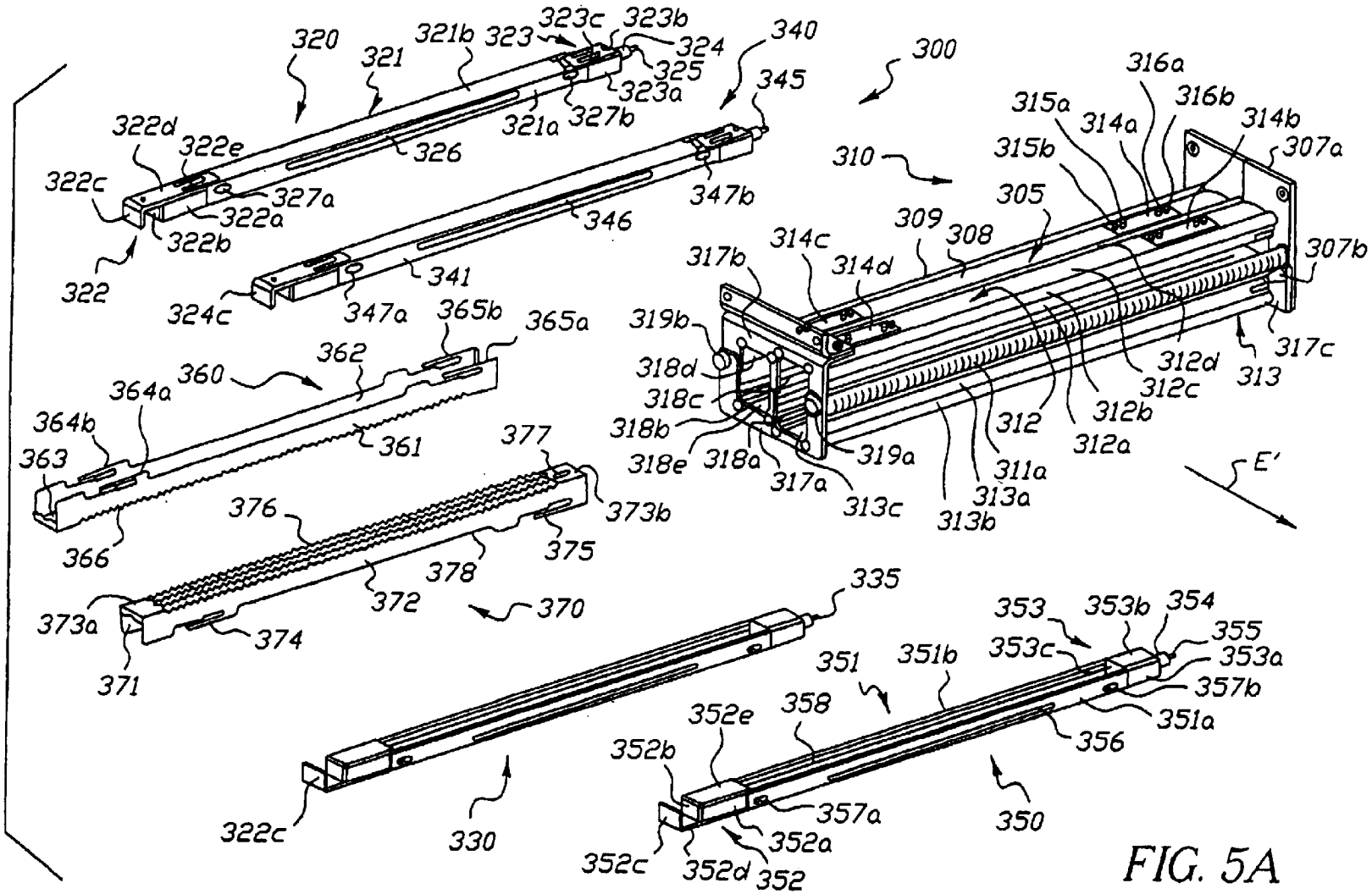
FIG. 5A is an illustration showing an exploded view of a partially disassembled web conditioning charging station of the invention, the illustration including a drawing of a supporting structure, drawings of first stage corona charging units removable from the supporting structure, and drawings of second stage corona charging units removable from the supporting structure, the second stage corona charging units associated with demountable grid members.

Illustrated in FIG. 5A is an exploded view showing a disassembled exemplary web conditioning charging station (WCCS) of the invention, designated by the numeral 300. WCCS 300 includes a supporting structure 310 and charging units 320, 330, 340, and 350. Charging units 320 and 330 are first stage corona chargers, i.e., corresponding for example to chargers 270*a* and 270*b* of FIG. 2. Charging unit 350 is associated with a removable grid member 370 (shown removed). In combination, unit 350 and grid member 370 form a second stage charger, corresponding for example to charger 275*b* of FIG. 2. Similarly, charging unit 340 is associated with a removable grid member 360, which together in combination form a second stage charger corresponding, for example, to charger 275*a* of FIG. 2. The charging units 320, 330, 340, and 350 are substantially the same as one another, i.e., are the same within manufacturing tolerances. Also, grid members 360 and 370 are substantially the same as one another within manufacturing tolerances.

The supporting structure 310 is oriented as illustrated with respect to the downstream direction of motion of a transport web, which direction of motion is shown by arrow E'. The transport web passes through structure 310 when the WCCS is operational in a printer (transport web not shown in FIG. 5A), and direction E' corresponds to direction E in FIG. 2. The illustrated orientations of charging units 320, 330, 340, and 350 and of grid members 360 and 370 are the same as when these elements are mounted within supporting structure 310. Charging unit 320 includes a shell 321 which further includes a side wall 321*a* and a back wall 321*b*. Similarly, charging unit 350 includes shell 351 which further includes side walls 351*a* and 351*b*, with side wall 351*b* corresponding to sidewall 321*a* of unit 320. Thus, each shell has a back wall and two sidewalls, the inner surfaces of which form three sides of a rectangular box. Charging unit 320 has a removable insulative end cap 322, seen in top and side view, which end cap covers an end wall (not visible) of the operative portion of shell 321. A similar end cap 352 of charging unit 350 is seen in bottom and side view, which view shows a corona wire 358 traversing the length of the open portion of charging unit 350. The open portion of charging unit 350 is defined by end cap 352 and a second removable insulative end cap 353 covering a second end wall (not visible) of the operative portion of shell 321. A second end cap 323 of charging unit 320, similar to end cap 353, is seen in top and side view. Each of the end caps 322, 323, 352, and 353 is molded as a single piece, and similarly for the similar end caps on chargers 330 and 340, respectively. End cap 322 of charging unit 320 includes a side wall 322*a*, an end wall 322*b*, a handle 322*c* for purpose of mounting charging unit 320 in supporting structure 310 (or removing the charging unit), and a top piece 322*d* which includes a spring portion 322*e*. The spring portion 322*e* snaps into a shallow outer recess in wall 321*b* (recess not illustrated) for purpose of attaching end cap 322 to shell 321. By lifting spring portion 322*e*, removable end cap 322 may be removed. Opposing top piece 322*d* is another wall (not visible) of end cap 322 which is similar to wall 352*e* included in end cap 352, and opposing side wall 322*a* is another side wall (not visible in FIG. 5A) similar to wall 352*a*. End walls 322*b* and 352*b* are similar to one another. Wall 352*e* of end cap 352 of charging unit 350 covers a portion of the corona wire 358, the end of which portion (not visible in FIG. 5A) is held under tension by a spring loaded mechanism (not illustrated), the spring loaded mechanism also being covered by wall 352*e*, and similarly for the other charging units. End cap 353 includes sidewalls 353*a* and 353*c*, and a wall 353*b* that covers the other end of wire 358, which end of the wire is attached to a metal pin 355. The pin 355 is surrounded by an insulative coating 354, which insulative coating is molded to the corresponding end wall (not visible) of shell 351. Pin 355 and coating 354 pass with clearance through a hole in the end wall of end cap 353 (end wall and hole not visible). End cap 323, which is similar in all respects to end cap 353, includes a side wall 323*a* and a top piece 323*b* which includes a spring portion 323*c*. The spring portion 323*c* snaps into a shallow outer recess in wall 321*b* (recess not illustrated) for purpose of attaching end cap 323 to shell 321. By lifting spring portion 323*c*, removable end cap 323 may be removed. Pin 325 and pin coating 324 pass with clearance through a hole in the end wall of end cap 323 (end wall and hole not visible). Each of charging units 320, 330, 340, and 350 is thus similarly provided with a dielectric shell, a tensioned corona wire, and two insulative end caps covering the ends of each corona wire, the opening between end caps defining the operational charging length of each such corona wire. The operational charging length of each of these corona wires is 366.5 mm, but may be any suitable length as required.

The corona wires, e.g., wire 358, have a preferred nominal diameter of 0.0033 inch and are preferably made of tungsten. The shells, e.g., shell 321, are preferably made of Mindel B-430 plastic. Shell side walls, e.g., 351*a,b* are about 2 mm thick, and shell back walls, e.g., back wall 321*b*, are about 2 mm thick. The end caps, e.g., end caps 322 and 323, are preferably made of flame retarded PET sold under the tradename Valox 310SEO. The pins, e.g., pin 325, are preferably made of a brass alloy. Other suitable materials may, however, be substituted to make the shells, end caps, corona wires, or pins.

Each of charging units 320, 330, 340, and 350 is provided with symmetrically located side rails, one side rail on the outer face of each side wall, e.g., side rails 326 and 356. The side rails, for purpose of mounting and demounting the charging units from the supporting structure 310 (see below) are preferably molded as portions of the shell during shell manufacture.

Each of charging units 320, 330, 340, and 350 is also provided with symmetrically located ears, with two ears on the outer face of each sidewall, e.g., ears 327*a,b* and 357*a,b*. These ears are preferably molded with the shell during shell manufacture and are aligned longitudinally with, and are similar in cross-section to, the side rails. The ears serve a double function, i.e., to aid mounting and demounting of the charging units from the supporting structure 310, and also to provide for attaching the grid members of the second stage chargers of WCCS 300. Thus, grid member 360 is for example detachably attachable to second stage charging unit 340 by using clips 364*a* and 365*a* which clips are respectively engagable to ear 347*a* and ear 347*b*, and by clips 364*b* and 365*b* which are engagable to ears (not visible and similar to ears 357*a,b*) on the outer face of the side wall opposite to side wall 341. Similarly, clips 374 and 375 on grid member 370 are respectively detachably attachable to ears 357*a* and 357*b* on second stage charging unit 350, and two clips (not visible) on the outer face of wall 351*b* are respectively detachably attachable to two ears (not visible) on the outer face of wall 351*b*. Each of the grid members, e.g., grid member 370, includes a gridded portion, e.g., grid 376. The grid members also include non-gridded portions, such as for example portions 373*a* and 373*b* and sidewalls such as side wall 372 (similar to sidewalls 361 and 362). When the grid members 360 and 370 are respectively attached to the charging members 340 and 350, the gridded portions, e.g., grid 376, overlap or lie above a portion of each of the end caps, e.g., of end caps 352 and 353. The grid members, e.g., grid member 370, are preferably made of stainless steel with each grid member preferably including an arrow, e.g., arrow 377 cut out of portion 373, the arrow for purpose of correctly guiding each assembled second stage charger into supporting structure 310. With the second stage chargers assembled, the side walls of the grid members overlap the side walls of the shells to a considerable extent. Thus, side wall 372 of grid member 370 overlaps side wall 351*a* of the shell of charging unit 350, with the lower edge portion of side wall 372 almost touching side rail 356, and similarly for the corresponding lower edge portion (not visible) of side wall 371. During operation of the second stage chargers with the grid members grounded, the overlapping side walls of the grid members advantageously act to enhance the efficiency of the chargers (see U.S. Pat. No. 6,038,120).

Supporting structure 310 includes two end plates 317*a* and 317*b* at one end, and end plates 307*a* and 317*c* at the other end. Four nominally the same, preferably metal, more preferably extruded aluminum, support elements such as for example support element 312 are held in place by the end plates. Support elements 305 and 312 for example are held in place by screws into end plates 317*b* and 307*a*. End plates 317*a* and 317*b* are preferably made of metal, and more preferably, stainless steel. End plates 307*a* and 317*c* are preferably made of a hard material, preferably an insulating plastic or dielectric polymeric material. Element 312 includes a side wall 312*a*, a curved section 312*b*, a roof section 312*c*, a second curved section 312*d*, and a second side wall (not visible) opposite to side wall 312*a*. The screws attaching element 312 to end plates 317*b* and to end plate 307*a* have threads entering threaded receptacles, the receptacles preferably located within the ends of the curved sections, such as curved sections 312*b,d*. The interior lengths of the sidewalls of element 312 are provided with longitudinal tracks, one pair of tracks along each sidewall, for purpose of supporting the upper second stage charger (which when assembled includes charging unit 340 and attached grid member 360). One of these pairs of tracks is identified by the numeral 318*c*, the other pair not being visible in FIG. 5A. When the assembled upper second stage charger is mounted in supporting structure 310 (or demounted) the rails such as rail 346 and the ears such as ears 347*a,b* slide in the space between the pairs of longitudinal tracks included in element 312. The corresponding other half of the second stage of WCCS 300 includes extruded aluminum support element 313 which is entirely similar to element 312. Support element 313 is attached to end plates 317*a* and 317*c* by screws. As indicated in FIG. 5A, support element 313 includes side wall 313*a*, curved section 313*b*, the inner surface of roof 313*c*, and the tracks 318*a*. When the assembled lower second stage charger (including charging unit 350 and grid member 370) is mounted in supporting structure 310 (or demounted) the rails, e.g., rail 356, and the ears, e.g. ears 357*a,b*, slide in the spaces between the pairs of tracks included in element 313.

The first stage of the WCCS 300 includes a supporting element 305 for the upper charger (corresponding to charger 270*a* of FIG. 2) which supporting element is entirely similar to elements 312 and 313. Thus, the element 305 includes the roof 308, the curved section 309, and tracks 318*d*. For supporting the lower first stage charger, a support element (of which only a small portion of the interior is visible) corresponds to and is entirely similar to element 305, which support element is attached by screws to end plates 317*a* and 317*c*. This support element for supporting the lower first stage charger includes the inner surface 318*e* of a roof similar to roof 308, and longitudinal tracks 318*b*.

The four nominally the same extruded aluminum support elements, e.g., elements 312, 313, 305, and the first stage complement to element 305 (not visible in FIG. 5A) each includes two steel leaf spring members for holding the first and second stage chargers securely in place within support member 310. Thus element 305 includes spring members 314*a* and 314*c*, and element 312 includes spring members 314*b* and 314*d*. Spring member 314*a* includes two hold-down screws 315*a,b*. Spring member 314*a* further includes a plastic pad (not visible) on the underside of the spring member, which plastic pad has two ears 316*a,b* which project through member 314*a* and thereby secure the plastic pad to member 314*a*. The plastic pads of the spring members have protuberances which snap into shallow recesses provided on the outer surfaces of the back walls of the shells of the charging units, thereby helping to secure the charging units in supporting structure 310. These plastic pads are preferably made of a polybutylene terephthalate sold under the tradename Valox 325.

The end plates 307*a* and 317*c* are preferably made of a strong, electrically insulating material, and these end plates are also preferably partially coated on their inner surfaces by a conductive screening material in order to reduce electromagnetic interference (EMI) from the corona charger high voltage wires. Preferably, end plates 307*a* and 317*c* are made of a flame retarded polyphenylene oxide sold under the tradename Noryl EN185. To provide partial coatings of conductive screening material on the inner surfaces of these end plates, a copper foil tape, sold under the tradename CHO-FOIL available from the Chomerics Corporation, may be applied. Most of the inner surface of each end plate is covered by the conductive tape in such manner as to avoid electrical contact or shorting to high voltage components, the conductive portions of the tape being preferably grounded. Alternatively, the conductive EMI shielding may be applied to the end plates 307*a* and 317*c* by other suitable means, e.g., by vacuum evaporation, as a conductive ink, and so forth.

The extruded aluminum support elements, e.g., element 312, are electrically grounded. Each of grid members 360 and 370 is grounded via metal spring clips embedded between the longitudinal tracks such as tracks 318*a* and 318*c* of the second stage support elements (metal spring clips not illustrated).

A downstream constraint ski member 311*a* is included in supporting structure 310 for purpose of controlling the positioning of a transport web through WCCS 300. An entirely similar upstream constraint ski member 311*b*, not visible in FIG. 5A, is identified in FIG. 3C). The transport web is passed in tension over ski members 311*a,b* in a manner analogous to that shown in FIG. 2. The ski members are preferably made of highly polished stainless steel rod, have a cylindrical cross-section and are securely and permanently attached at both ends to end plates 317*b* and 307*a*. With end plate 317*b* partially overlapped by end plate 317*a*, the threaded portion of a thumbscrew 319*a* passes through a hole in end plate 317*a* and screws into a threaded hole coaxial with the longitudinal axis of ski member 311*a*, the head of the thumbscrew thereby acting to press and secure a portion of end plate 317*a* against a portion of end plate 317*b*. A similar thumbscrew 319*b* similarly screws into the upstream constraint ski member 311*b* of FIG. 5C.

The supporting structure 310 is dissectible into an upper section and a lower section by unscrewing and removing the thumbscrews 319*a,b*. The upper section of supporting structure 310 includes the end plates 317*b* and 307*a*, the first stage support element 305, the second stage support element 312, as well as the downstream ski member 311*a* and its upstream counterpart 311*b* (visible in FIG. 5C). The lower section includes end plates 317*a* and 317*c*, as well as the second stage support element 313 and its first stage counterpart (partially visible in FIG. 5A, not separately identified). End plate 307*a* is provided on the downstream side with a beveled pin 307*b* which has a precision cylindrical shoulder, which shoulder snugly fits into a round hole in end plate 317*c*. A corresponding beveled pin 307*c* (not visible in FIG. 5A, see FIG. 5C) has a precision shoulder that similarly mates with an upstream hole in end plate 317*c*. Thus pins 307*b,c* act to both locate and support an end of the lower section of supporting structure 310, with the other end located and fixed into position by the thumbscrews 319*a,b*. When thumbscrews 319*a,b* have been unscrewed and removed, the entire lower section of supporting structure 310 may be slid off the pins 307*a,b* and thereby separated from the upper section. It will be evident that this may be done with or without the first and second stage chargers in place. Removal of the demountable lower section of supporting structure 310 provides advantageous access to the transport web, e.g., for purpose of replacement of a worn or damaged web. Thus, when a transport web is being replaced, the upper section of supporting structure 310 is advantageously not disturbed, and therefore, after a new transport web has been installed, the entire WCCS 300 is readily reinstalled to proper operating position, with high reliability.

Figure 5B:
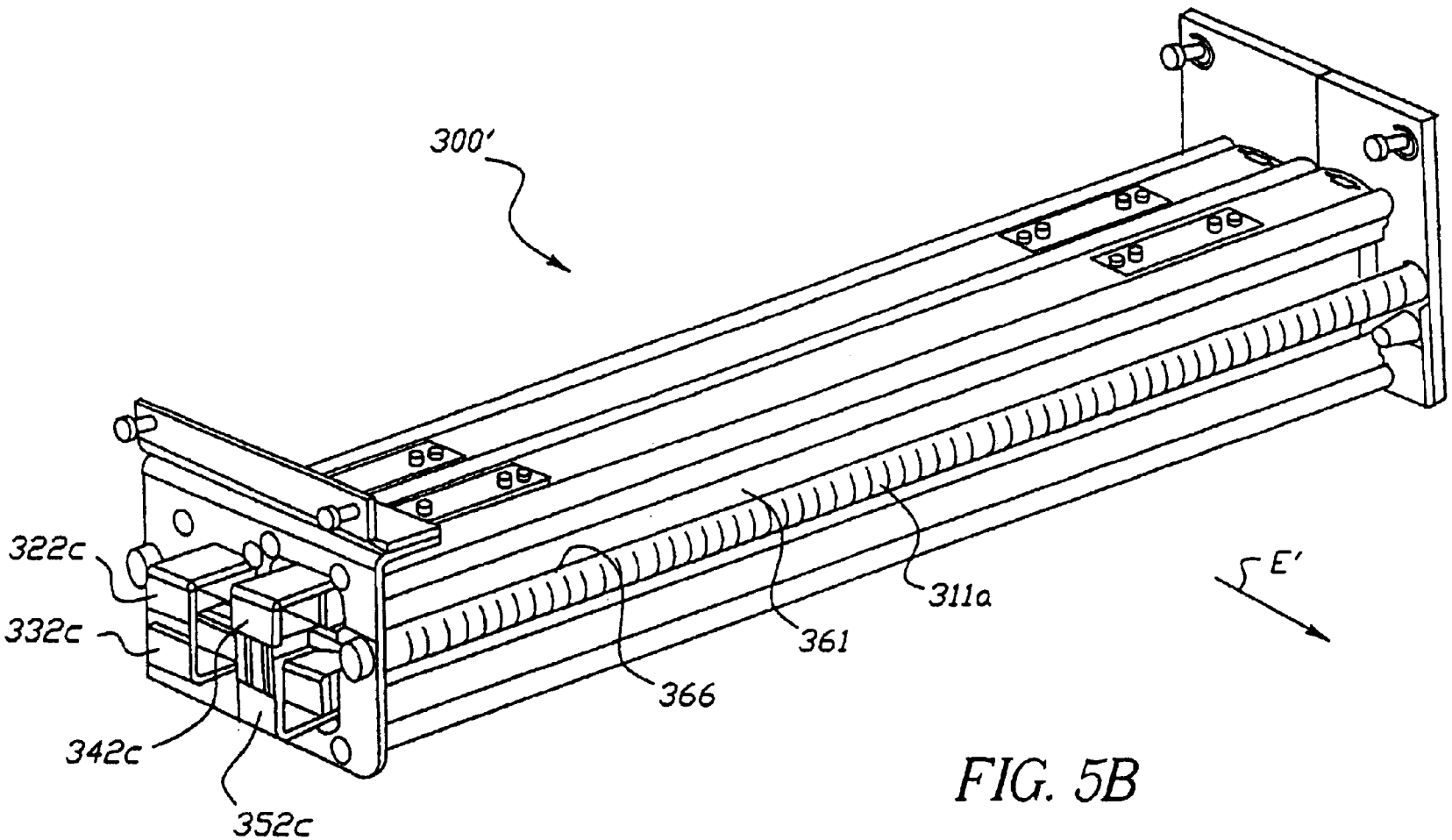
FIG. 5B is a view, as seen from the downstream side and front, of the assembled web conditioning charging station of FIG. 5A, showing tabs for purpose of removal of first stage and second stage chargers from the supporting structure.

FIG. 5B shows the fully assembled web conditioning charging station, indicated as 300', oriented the same way as supporting structure 310 shown in FIG. 5A (seen from downstream) and with the first and second stage chargers in place. Handles 322*c* and 332*c* are for mounting or demounting of the first stage chargers, and handles 342*c* and 352*c* are for mounting or demounting of the second stage chargers. Handles 322*c*, 332*c*, 342*c*, and 352*c* are also identified in FIG. 5A. FIG. 5B also shows side wall 366 and part of grid 366 of grid member 360, with downstream constraint ski 311*a* also identified.

Figure 5C:
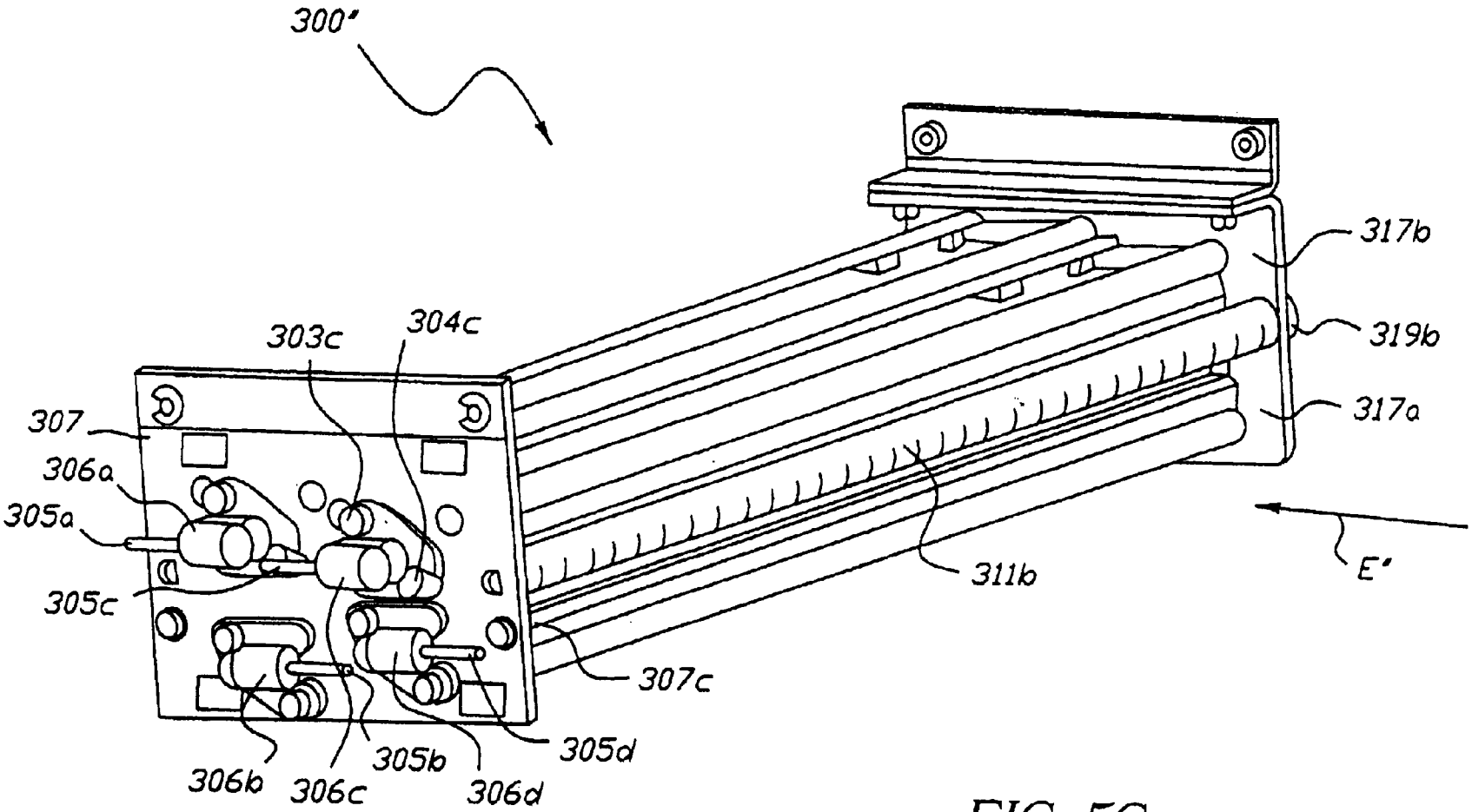
FIG. 5C is a view, as seen from the upstream side and rear of the supporting structure of FIG. 3A, illustrating connectors for purpose of connecting corona wires to high voltage AC sources, the connectors insulatively supported by the supporting structure.

FIG. 5C shows the web conditioning charging station indicated as 300" seen from upstream, where the arrow E" indicates the downstream direction of motion of the transport web (web not shown). This view illustrates the upstream constraint ski 311*b* (not visible in FIGS. 5A,B) as well as part of beveled pin 307*c* (not visible in FIGS. 5A,B). High voltage wires located within four high voltage shielded electrical cables 305*a*, 305*b*, 305*c*, 305*d* (shown as cut off short lengths) are connected to HV power supplies for energizing the respective corona wires, as illustrated in FIG. 2. The wires within the cables 305*a*, 305*b*, 305*c*, 305*d* also connect, via respective insulated cover elements 306*a*, 306*b*, 306*c*, 306*d*, to the high voltage pins 345, 355, 325, and 335 illustrated in FIG. 5A. Each of these pins fits snugly into a female receptacle located within the corresponding cover element, the cover elements themselves being precisely located and held by screws, such as for example screws 303*c* and 304*c*. Thus, the engagement of each of the pins with the corresponding female receptacle secures the charger in its proper location.

As illustrated by FIGS. 5A,B,C, it will be evident that a preferred web conditioning charging station of the invention embodies predetermined, accurate, fixed spacings between each of the first and second stage chargers and between the chargers and either side of the transport web passing through the web conditioning charging station. Moreover, the preferred web conditioning charging station also has predetermined, accurate, fixed spacings between the two corona wires included in the first-stage chargers, as well as predetermined, accurate, fixed spacings between the two grids of the grid members included in the second-stage chargers. However, the as-manufactured wire-to-wire separation provided in the first stage is typically optimized for a given speed of motion of the transport web, and different as-manufactured wire-to-wire separations may be appropriate for different web speeds. Similarly, the as-manufactured grid-to-grid separation provided in the second stage is typically optimized for a given speed of motion of the transport web, and different as-manufactured grid-to-grid separations may be appropriate for different web speeds. Thus, web conditioning charging stations may be manufactured with differing fixed geometries for different web speeds.

Moreover, although not included in the web conditioning charging station illustrated in FIGS. 5A,B,C, one or more mechanisms (not illustrated) may alternatively be provided for allowing adjustment of the first stage and/or second stage spacing, e.g., without needing to remove the web conditioning charging station from the printer. Such mechanisms may include, for example, screw devices with verniers, such as micrometers.

Figure 6:
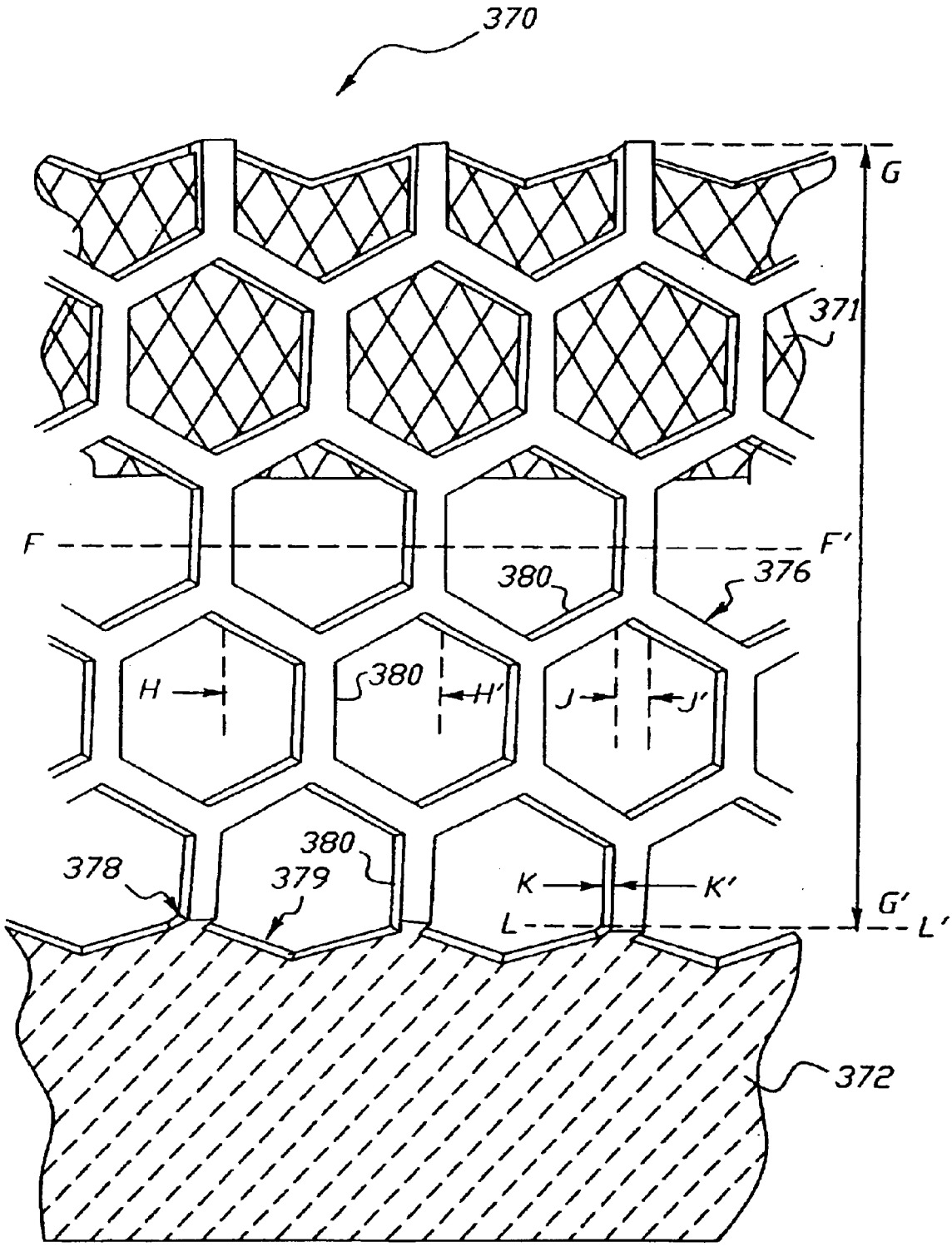
FIG. 6 is an enlarged view, as seen from the top and side, of a partial cutaway of a grid member of a second stage charger.

FIG. 6 shows an enlarged view, as seen from the top and side, of a partial cutaway of grid member 370 of FIG. 5A, with grid 376 and sidewalls 371 and 372 identified. Grid member 370 is substantially the same as grid member 360, and is made from 0.020 inch thick stainless steel stock. The grid openings 380 are formed by a photoetching process, the sidewalls 371 and 372 are formed by a bending machine, and the grid member is electropolished. Thus the sidewalls 371 and 372 are approximately 0.020 inch thick, as is the thickness K . . . K'. However, this thickness is not critical. The grid 376 is hexagonal, wherein the hexagonal openings have a center-to-center distance of approximately 0.281 inch, equal to distance H . . . H'. The width J . . . J' of the grid mesh is approximately 0.027 inch, resulting in a grid transparency of about 81%. Grid 376 is disposed such that it is longitudinally symmetrical about the dashed line F . . . F', which is located half way across the width of the grid member, which width G . . . G' is approximately one inch (center side wall-to-center side wall). The bends of the grid, e.g., along dashed line L . . . L' produce bends in the grid mesh, e.g., bend 378, which typically are not a sharp bends as sketched but have a radius of curvature arising from the bending process of grid manufacture. Bending of the grid typically produces vee-shaped side openings in the walls, e.g., portion 379 in wall 372.

Notwithstanding the foregoing description relating to FIG. 6, the grid members 360 and 370 included in the web conditioning charging station 300 of FIG. 2 may have a different geometry from that of FIG. 6, including a pattern different from hexagonal, a different transparency, a different width (G . . . G'), and so forth. As an example, alternative grids made from longitudinally tensioned parallel slats have been successfully tested in station 300 with resulting satisfactory performance.

An advantageous feature of the design of WCCS 300 is the EMI screening of the high voltage corona wires. Such screening is provided by the metallic support elements, e.g., support member 312, by the metallic end plates 307*a* and 307*b*, and to a lesser extent by the metallic grid members, e.g., grid member 370. This is in addition to any EMI screening provided by conductive coatings that may be applied to the interior surfaces of the otherwise electrically insulating end plates 317*a* and 317*b*, as described above.

Although no corona wire cleaning mechanism is shown as being incorporated in any of the chargers of WCCS 300, such wire cleaning mechanisms may optionally be included in the chargers, the wire cleaning mechanisms being manually operated or motor operated.

The following Examples below illustrate real time operation of WCCS 300. For all the Examples, the transport web was made of polyethyleneterephthalate approximately 100 μm thick. For certain of the Examples, the web conditioning charging station was mounted in a modular printer as exemplified by FIGS. 1 and 2, and negatively charged toners were employed in conjunction with discharged area development, so that the outer face of the incoming transport web was negatively charged. In other examples, the web conditioning charging station was mounted in a test apparatus, and the incoming charge on the web was applied so as to simulate actual operation of the printer.

EXAMPLES

Example 1

Voltage Scans After Web Conditioning

Figure 7A:
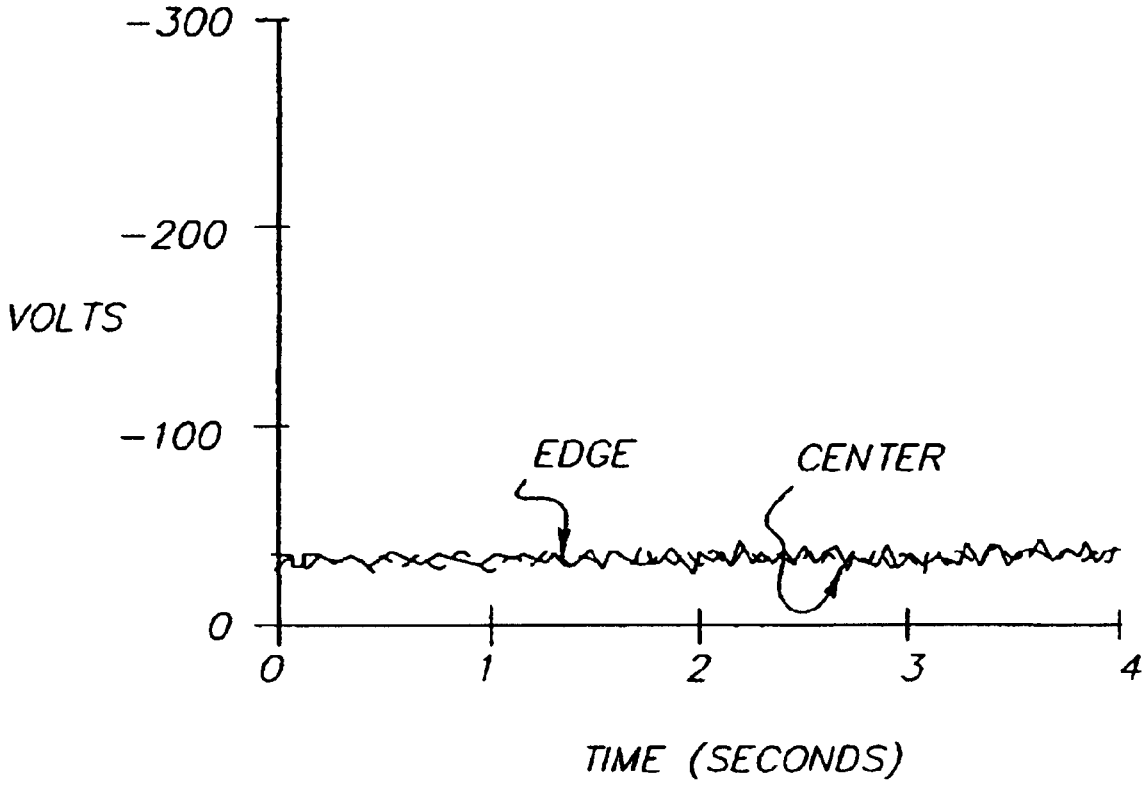
FIG. 7A compares voltage scans measured near an edge and near the center of the outer face of the transport web after the web has moved past the web conditioning charging station.
Figure 7B:
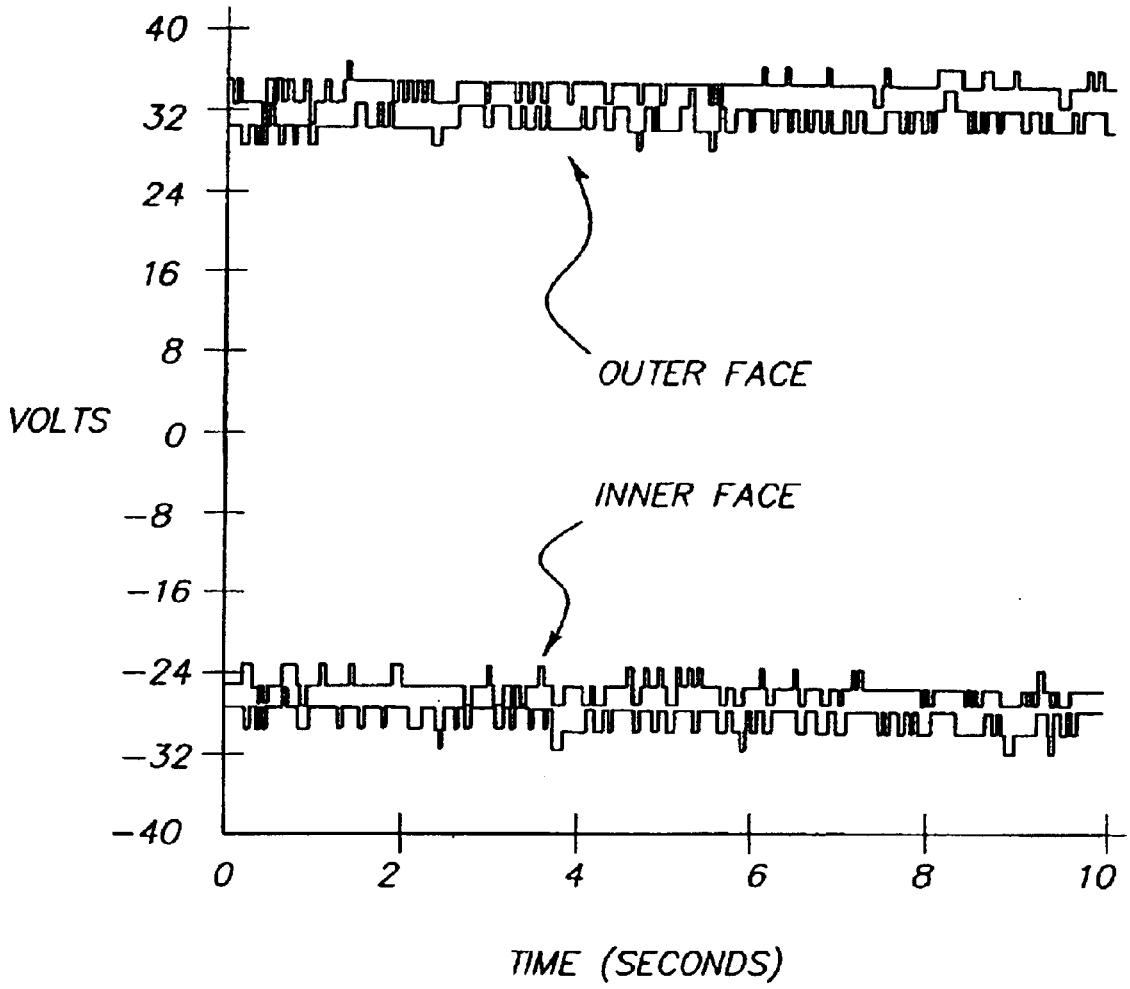
FIG. 7B shows typical voltage scans for both the outer and inner faces of the transport web after the web has moved past the web conditioning charging station (each face measured separately)

In this Example, voltage on the transport web was measured downstream of the web conditioning charging station which was similar to WCCS 300 and operating in real time in a machine configuration similar to that of FIG. 2. The web conditioning charging station was located in a fully operational 4-module printer similar to that of FIG. 1. There was no detack charger. All of the modules were operational in transferring toner images to receiver members, with a nominal transfer current per module of about 28 μa. The receiver members were electrostatically adhered to the transport web by a tackdown charger, as described above, using a nominal tackdown current of about 13 μa. The transport web was moved at 300 mm/sec. Both first and second stages were operated at 400 Hz. The wire-to-wire separation in the first stage, e.g., between wires 255 and 257, was nominally 11.2 mm with no applied asymmetry, and the grid-to-grid spacing in the second stage, e.g., between grid members 260 and 261, was nominally 3.0 mm with no applied asymmetry. In this test, each of the first stage chargers was operated at an rms current of 400 μa, and each of the second stage chargers at 800 μa. Each of the first-stage and second-stage corona wires was 366.5 mm in length. After web conditioning, voltage scans were obtained from the moving transport web downstream of the web conditioning charging station, with the voltages measured by electrostatic probes mounted close to web surface. Opposing each probe on the reverse side of the web was mounted a grounded electrode in intimate contact with the surface of the web, the grounded electrode in the form of a one-half inch wide ribbon of 0.002 inch spring steel shimstock mounted as a convex bow with the crest pressed against the web. FIG. 7A shows voltage scans obtained from the front surface of the web passing by two such probes, the scans resulting from using typical rms current setpoints in the web conditioning charging station. As described in a foregoing section, the incoming voltage across the web (upstream of the web conditioning charging station) is typically several thousand volts, with the outer face negative. One of the probes was situated near the center of the outer face of the web, and the other near an edge of the of the outer face web and situated so as not to measure the control patches. Over a time interval of 4 seconds, the edge probe measured an average surface potential of −31 volts with a standard deviation of 2.8 volts, and the center probe measured −36 volts with a standard deviation of 2.3 volts. Thus, the magnitudes of the measured surface potentials were very low, showing that the incoming surface potential was almost completely neutralized. Moreover, the web was shown to be very uniformly discharged both along its length and across its width. FIG. 7B shows measured surface potentials on both sides of the transport web, using the same type of grounded contacting backing electrodes opposing the probes as described for FIG. 7A. In this test, each of the first stage chargers was operated at an rms current of 700 μa, and each of the second stage chargers at 620 μa. As measured over a time interval of 10 seconds, the results show a very low, very uniform, surface potential on each side of the web, with the outer face reading about +31 volts and the inner face reading about −27 volts. In this case, the polarities of the potentials on both faces became reversed from the initial, upstream, potentials. A residual polar charge corresponding to about 27 volts was left across the web, well below the aim value of 50 volts. Also, there was a residual net charge per unit area corresponding to about 4 volts which was probably caused as the result of some tolerance asymmetry, e.g., due to manufacturing tolerances of the charger components, or small differences of spacings of the chargers from the transport web.

Example 2

Robustness Tests—Temperature, Humidity, Charger Spacings

In Example 2, performance robustness of the web conditioning charging station of Example 1 was tested by systematically varying, in the same 4-module printer operating at the same process speed, the ambient temperature, the relative humidity, and the charger spacings. The printer was not equipped with an environmental control device such as an air conditioner for controlling internal ambient temperature and relative humidity, the entire printer being located for the tests in an environmentally controllable chamber. Two different combinations of temperature and relative humidity (62° F./20% RH, 75° F./75% RH) and three sets of charger spacings were employed, as listed in Table 1. Each of the first stage chargers was operated at an rms current of 530 μa, and each of the second stage chargers at 1020 μa. Both first and second stages were operated at 400 Hz. The first column of Table 1 lists the total current pre-applied to the web, i.e., from the tackdown charger and from transfer currents prior to conditioning in the web conditioning charging station. In certain control experiments, the tackdown current and the transfer currents were all zero (no imaging). These control experiments were done so as to compare with a fully loaded operating condition, i.e. with a nominal total transfer current from the 4 modules of about 140 μa and a tackdown current of about 13 μa (i.e., a total of about 153 μa delivered to the transport web upstream of the web conditioning charging station). These currents were defined as positive when flowing to the inner face of the transport web, and thus a positive current resulted from a deposition of negative charge on the outer face.

TABLE 1

Robustness Tests

| Pre-Applied Current (μa) | Ambient Conditions* | Spacings** | Outer Face (Volts) | Inner Face (Volts) | From Net Charge (Volts) | From Polar Charge (Volts) |
|---|---|---|---|---|---|---|
| 0 | 62/20 | close | 46.0 | −49.2 | −3.2 | 46.0 |
| 0 | 62/20 | nominal | 28.8 | −16.9 | 11.9 | 16.9 |
| 0 | 62/20 | nominal | 4.6 | −34.3 | −29.7 | 4.6 |
| 0 | 62/20 | far | 2.6 | −25.9 | −23.3 | 2.6 |
| 0 | 75/75 | close | 53.8 | −74.5 | −20.7 | 53.8 |
| 0 | 75/75 | nominal | 28.3 | −32.0 | −3.7 | 28.3 |
| 0 | 75/75 | far | −6.2 | −3.0 | −9.3 | 3.0 |

TABLE 1-continued

Robustness Tests

| Pre-Applied Current (μa) | Ambient Conditions* | Spacings** | Outer Face (Volts) | Inner Face (Volts) | From Net Charge (Volts) | From Polar Charge (Volts) |
|---|---|---|---|---|---|---|
| 153 | 62/20 | close | 58.8 | −61.3 | −2.5 | 58.8 |
| 153 | 62/20 | close | 58.9 | −59.6 | −0.7 | 58.9 |
| 153 | 62/20 | close | 52.3 | −49.5 | 2.8 | 49.5 |
| 153 | 62/20 | close | 51.3 | −49.8 | 1.4 | 49.8 |
| 153 | 62/20 | nominal | 28.8 | −24.6 | 4.3 | 24.6 |
| 153 | 62/20 | nominal | 6.0 | −41.1 | −35.1 | 6.0 |
| 153 | 62/20 | nominal | 8.9 | −43.7 | −34.8 | 8.9 |
| 153 | 62/20 | far | −23.9 | 11.2 | −12.7 | 11.2 |
| 153 | 75/75 | close | 49.9 | −63.4 | −13.5 | 49.9 |
| 153 | 75/75 | close | 46.7 | −66.5 | −19.8 | 46.7 |
| 153 | 75/75 | close | 49.2 | −72.3 | −23.1 | 49.2 |
| 153 | 75/75 | nominal | 22.7 | −25.0 | −2.3 | 22.7 |
| 153 | 75/75 | far | −68.8 | 73.1 | 4.3 | 68.8 |

*T(° F.)/RH(%)
**See text

TABLE 2

Charger Spacings and First Stage Asymmetries

| Spacing Definition | First Stage Asymmetry | Second Stage Asymmetry | 1st Stage Spacing Wire-to-Wire (mm) | 2nd Stage Spacing Grid-to-Grid (mm) |
|---|---|---|---|---|
| "close" | +0.309 | +0.600 | 9.7 | 2.5 |
| "nominal" | zero | zero | 11.2 | 3.0 |
| "far" | −0.236 | −0.429 | 12.7 | 3.5 |

Table 2 shows three sets of charger spacings used for the robustness tests of Table 1, i.e., "close", "nominal", and "far". In these tests, the "nominal" spacings were the same as for Example 1. A corresponding first-stage asymmetry (Table 2, Column 2) was applied for each of these spacings. For example, in row 1 the first-stage asymmetry of +0.309 was produced from a symmetric starting point by displacing the outer first stage charger a distance of 1.5 mm towards the transport web and also displacing the inner first stage charger 1.5 mm away from the transport web, while the second-stage asymmetry of 0.600 was produced by displacing the outer second stage charger a distance of 0.75 mm towards the transport web and displacing the inner second stage charger 0.75 mm away from the transport web. During these tests, when the wire-to-wire spacing of the first stage was increased (decreased), the grid-to-grid spacing of the second stage was also increased (decreased), i.e., the first stage and second stage spacings were never changed oppositely.

Examination of Table 1 reveals that as the first and second stage spacings were increased from "close" to "far", and independently of the incoming load or ambient condition, the post-conditioning voltage on the outer face (Col. 4) became monotonically less positive and the post-conditioning voltage on the inner face (Col. 5) became monotonically less negative. The post-conditioning voltages were measured on each face as described in Example 1 above. In certain tests the polarities of the post-conditioning voltages became reversed when the spacings were increased from "nominal" to "far", i.e., the outer face changed from positive to negative and the inner face, negative to positive.

Such reversals are ascribed to the fact that first-stage and second-stage asymmetries (Table 2) were included in the robustness tests for Table 1. However, Table 1 shows that the sensitivity to spacing changes of the post-conditioning surface potentials on the web is much larger than the sensitivity due to ambient changes. Moreover, Table 1 includes control tests having zero current applied to the web from tackdown charger or transfer stations (first six rows of Table 1). These control tests, when compared with the other tests which included high surface potentials on the web upstream of the web conditioning charging station, show that downstream surface potentials on the web are relatively insensitive to the incoming voltage level, and are much more sensitive to spacing. However, the most important conclusion to be drawn from Table 1 is that after conditioning of the web by the web conditioning charging station, both the residual voltage due to net charge (Col. 6) and the residual voltage due to polar charge (Col. 7) are small, independent of any other factor. Thus, for any spacing, the magnitude of the voltage due to net charge did not exceed about 35 volts, and the voltage due to polar charge did not exceed about 69 volts. For the "nominal" spacing, typically used in a printing machine, these voltages were about 35 volts and about 28 volts, respectively. The small magnitude of the latter figure of 28 volts is important, because polar charge on the web can have a significant effect on the transfer efficiencies in the modules, and the measured 28 volts is well below the aim value of about 50 volts after post-conditioning.

Example 3

First-Stage Asymmetry Tests

In Example 3, the influence of first-stage asymmetry on the web surface potentials after first-stage web conditioning was examined in a test apparatus. For these tests (see Table 3) the second stage of the web conditioning station was deactivated, because it was separately demonstrated that second-stage asymmetry has only a comparatively minor effect. Pre-applied currents were applied to the transport web to simulate the effects of toner transfer and receiver member tackdown, as described elsewhere above. The pre-applied current loads were either zero or ±153 $\mu$a, which are the same test magnitudes as used for Example 2. As explained for Example 2, and as reflected by the measured incoming outer face voltages in Table 3 (column 3), a pre-applied current of +153 $\mu$a produced a negative charge on the outer face, and a pre-applied current of −153 $\mu$a, a positive charge. The rms currents when operating under the nominal conditions, i.e., zero asymmetry and a wire-to-wire spacing of 11.2 mm, were similar to the corresponding first-stage rms currents of Example 2. Each of the corona wires was 366.5 mm in length.

TABLE 3

Effect of First-Stage Asymmetry (Second Stage Deactivated)

| Expt. No. | Asymmetry | Wire to Wire Spacing (mm) | Pre-Applied Current to Web ($\mu$a) | Incoming Outer Face Voltage (V) | Outgoing Outer Face Voltage (V) | Outgoing Inner Face Voltage (V) |
|---|---|---|---|---|---|---|
| 1 | zero | 11.2 | 0 | +20 | +32 | −60 |
| | | | | +60 | +35 | −100 |
| 2 | zero | 11.2 | +153 | −4400 | <u>+118</u> | −90 |
| | | | | −4310 | <u>+200</u> | −190 |
| 3 | zero | 11.2 | −153 | +4485 | <u>−60</u> | +34 |

TABLE 3-continued

Effect of First-Stage Asymmetry (Second Stage Deactivated)

| Expt. No. | Asymmetry | Wire to Wire Spacing (mm) | Pre-Applied Current to Web ($\mu$a) | Incoming Outer Face Voltage (V) | Outgoing Outer Face Voltage (V) | Outgoing Inner Face Voltage (V) |
|---|---|---|---|---|---|---|
| 4 | −0.318 | 11.2 | 0 | −270 | −250 | +200 |
| | | | | −245 | −255 | +225 |
| 5 | −0.318 | 11.2 | +153 | −4720 | −180 | +190 |
| | | | | −4630 | −128 | +140 |
| 6 | +0.318 | 11.2 | 0 | +330 | +300 | −380 |
| | | | | +345 | +315 | −400 |
| 7 | +0.318 | 11.2 | +153 | −4440 | <u>+65</u> | −50 |
| | | | | −4390 | <u>+80</u> | −85 |
| 8 | +0.233 | 15.3 | 0 | +18 | +15 | −55 |
| 9 | +0.233 | 15.3 | +153 | −4880 | −335 | +430 |
| 10 | +0.233 | 15.3 | 0 | +260 | +255 | −215 |
| 11 | +0.233 | 15.3 | +153 | −4840 | −330 | +445 |

In Table 3, the experimental run number is shown in column 1. Most of the wire-to-wire spacings were the same as the "nominal" value in Table 2 of Example 2, i.e., 11.2 mm (runs 1–7), while in runs 8–11 this spacing was increased to 15.3 mm. In the majority of the runs, a repetition on a different day produced a second set of data (columns 5, 6, and 7). The numbers in column 5 show the polarity and magnitude of the voltage measured on the outer face of the transport web before web conditioning, and the numbers in columns 6 and 7 show the polarity and magnitude of the voltage on the outer and inner faces after web conditioning. These voltages were measured as described for Example 1. Comparison of runs 1 and 2 of Table 3 (columns 6 and 7) with the corresponding "nominal" data from Table 1 illustrates the beneficial effect of the second stage as was used in Example 2, i.e., the magnitudes of the voltages in columns 6 and 7 of Table 3 are much greater than the corresponding magnitudes in Table 1. Moreover, comparison of runs 2 and 3 shows that the first stage of the web conditioning charger is able to handle with equal ease a large negative incoming outer face surface potential and a large positive incoming outer face surface potential on the web. The underlining of the data values in column 6 emphasizes that the incoming polarity on the outer face was in fact reversed by the first stage, i.e., there was an overshoot. Data values in columns which are not underlined exhibit undershoot.

Turning to the effects of asymmetry, comparison of runs 2, 5, and 7 (column 6) shows that a positive asymmetry is better than zero asymmetry or a negative asymmetry in reducing the magnitude of the outer face voltage (for a large negative incoming outer surface potential). On the other hand, at the larger wire-to-wire spacing and smaller asymmetry (+0.233) in runs 9 and 11, there was no observed effect of the asymmetry within experimental error, and the first-stage charger clearly operated much less efficiently at the larger spacing.

The overshoots observed in runs 2 and 7 using positive asymmetry under full load are indications of high first-stage efficiency. The extra performance under these first-stage conditions can advantageously be traded off in various ways in an operating printer (when coupled with the second stage of the web conditioning charging station). Thus a greater loading (transfer current) can be used in the transfer station (s), or an extra module can be included in the printer, or the first-stage corona chargers can be run at lower peak voltages so as to prolong charger life, and so forth.

Example 4

Web Conditioning at a Higher Web Speed

In this example, the web conditioning charger 300 was tested in a single-module test device at a higher web speed, i.e., with a transport web speed of 450 mm/sec as compared to 300 mm/sec for the 4-module printer of Examples 1 and 2. The tackdown and transfer currents were applied to the web upstream of the web conditioning charging station so as to simulate tackdown and transfer for a 1-module and a 5-module printer, and for the 5-module simulation resulting in a highly negatively charged outer face of the web prior to web conditioning. The tackdown charging current was 30 $\mu$a throughout, and the assumed transfer current per module was 37.5 $\mu$a. This resulted in a total pre-applied current of 67.5 $\mu$a for the 1-module simulation, and 217 $\mu$a for the 5-module simulation. wire spacings in Example 4 were the "nominal" spacings of Table 2. The first-stage and second-stage asymmetries were both substantially zero. The listed rms currents included the displacement currents, and the rms current per second stage charger was 620 $\mu$a in all the tests. Each of the first-stage and second-stage corona wires was 366.5 mm in length. Both first and second stages were operated at 400 Hz. Results are given in Table 4, with the post-conditioning voltage measured on each face as described in Example 1 above.

TABLE 4

Higher Speed Performance

| Applied Current to Web ($\mu$a) | rms Current per 1st Stage Charger ($\mu$a) | rms Current per 2nd Stage Charger ($\mu$a) | Post-Conditioning Volts on Outer Face |
|---|---|---|---|
| 67.5 | 700 | 620 | −13 |
| 67.5 | 800 | 620 | 12 |
| 67.5 | 900 | 620 | 25 |
| 67.5 | 1,000 | 620 | 28 |
| 217 | 700 | 620 | −142 |
| 217 | 800 | 620 | −19 |
| 217 | 900 | 620 | 20 |
| 217 | 1,000 | 620 | 38 |

As shown by the first row of Table 4 for the simulated 1-module printer, the web conditioning charging station operating at an rms current per first stage charger of 700 $\mu$a, a satisfactorily small post conditioning average voltage of —3 volts was measured on the outer face of the transport web. Raising the first stage rms currents (rows 2, 3, 4) caused the post-conditioning average surface potential on the outer face of the web to change polarity from negative to positive (overshoot), with the downstream voltage on the outer face remaining satisfactory small. On the other hand, for the five-module simulation (rows 5–8) using a total applied load of 217 $\mu$a, a less than satisfactory performance resulted when the rms current per first stage charger was 700 $\mu$a (row 5). However, raising the first stage rms current to 800 $\mu$a produced satisfactory performance (row 6), with a surface potential on the outer face of just −19 volts after web conditioning. Further increases in first stage current (rows 7 and 8) reversed the post-conditioning polarity without noticeably improving the performance. Thus it is demonstrated by Example 4 that a web conditioning charging station of the invention is suitable for use in a 5-module printer operating at a throughput speed of at least 450 mm/sec (the 5-module printer including electrostatic tackdown of receiver members).

Example 5

Effect of the Second Stage

In Example 5, rms current setpoints for the first and second stages of the web conditioning charging station were systematically varied in order to ascertain the effects on post-conditioning web voltages and their associated standard deviations. The data were input into a computer program so as to predict a favorable operating condition of the web conditioning charging station. For Example 5, the incoming polar charge on the web was equivalent to a potential difference across the web of between about −3,600 volts and about −4,000 volts, and the first stage and second stage spacings were "nominal" (see Table 2) with no applied asymmetry. Both first and second stages were operated at 400 Hz. The material and speed of the transport web were the same as in Example 1 above, and post-conditioning voltages were measured on each face of the web as described in Example 1. Each of the first-stage and second-stage corona wires was 366.5 mm in length.

Figure 8A:
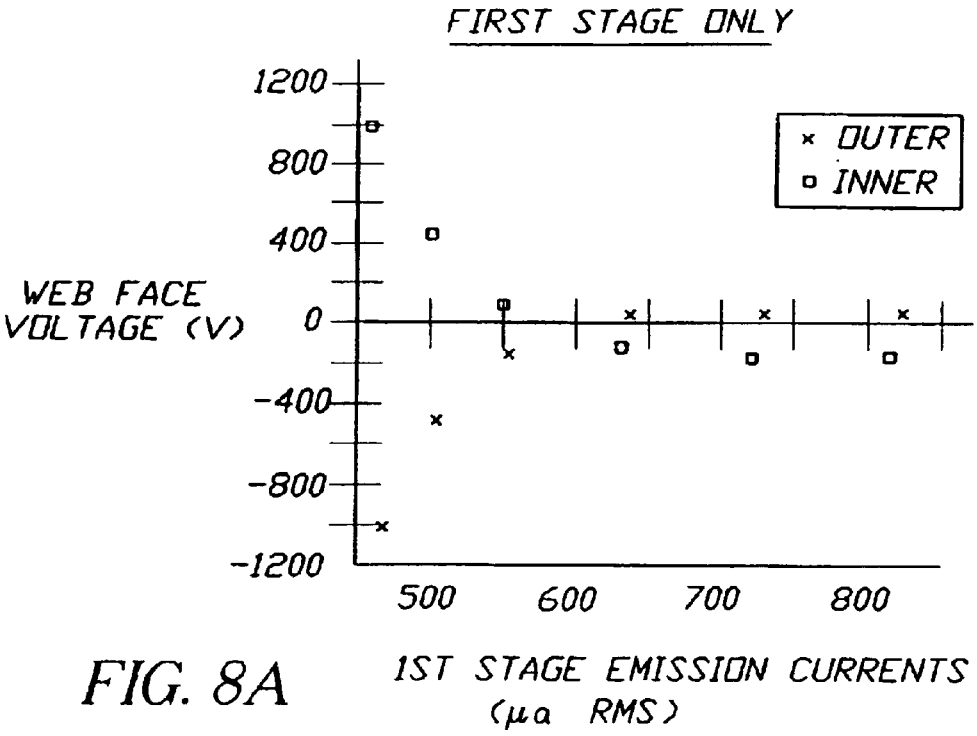
FIG. 8A shows post-conditioning surface potentials as functions of first stage emission current when using only the first stage of the web conditioning charging station.

FIG. 8A illustrates results of utilizing only the first stage of the web conditioning charging station, i.e., with the second stage not operating. The post-conditioning surface potentials on each face (corresponding to post-conditioning polar charge densities) are plotted as functions of the first stage rms emission currents of the respective first stage chargers (first stage charger emission currents being equal). The plots show that charge neutralization is very sensitive to the rms emission current for currents less than about 600 $\mu$a, and in fact charge neutralization is very poor for rms currents of about 450 $\mu$a. Moreover, the polarities of the post-conditioning surface potentials both change sign near about 590 $\mu$a, and at higher currents these surface potentials reach plateau magnitudes which exceed the aim magnitudes of ±50 V. In the present case, only for a narrow window of rms emission currents centered near about 590 $\mu$a are the magnitudes of the post-conditioning surface potentials satisfactory. Separate tests show that the amount of overshoot in polarity reversal, such as illustrated in FIG. 8A, is sensitive to the polar charge density on the incoming transport web, with the magnitude of the overshoot voltages increasing as the incoming transport web is more highly charged. For low amounts of polar charge on the incoming transport web, undershoot is typically observed, i.e., the post-conditioning surface potentials do not reverse polarity as the rms emission currents are increased. Generally, in order to achieve satisfactory neutralization of the transport web without using a second stage according to the invention, recourse would have to be made to embellishments such as for example set-up adjustments (e.g., spacing adjustments) or feedback or feedforward mechanisms, all of which are either cumbersome or costly. In fact, the use of a single stage web conditioning charging station having open wire chargers is inherently not robust to the level of incoming polar charge, and the resulting degree of web neutralization that can be produced by such a station (without using set-up adjustments or feedback or feedforward) is dependent not only upon the incoming polar charge density but also upon other variable factors such as ambient temperature, RH, tolerancing errors in construction of the chargers, tolerancing errors in mounting of the chargers, corona wire aging, and so forth.

Figure 8B:
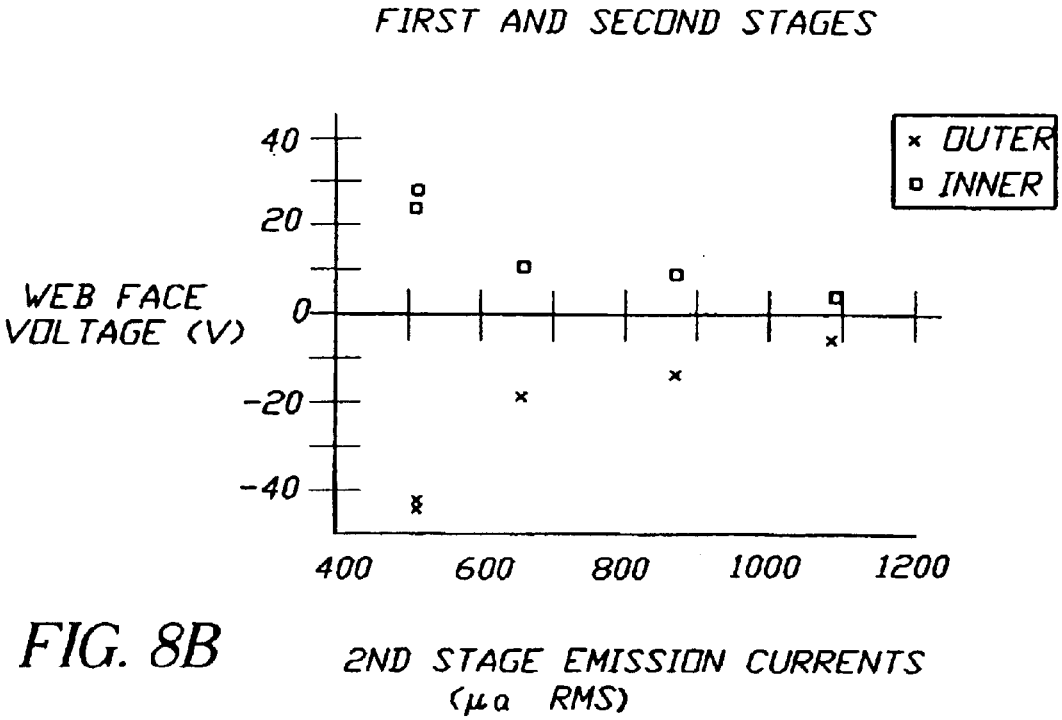
FIG. 8B shows post-conditioning surface potentials as functions of second stage emission current when using both the first and second stages of the web conditioning charging station.

FIG. 8B illustrates the great improvement provided by the present invention using gridded second-stage chargers. Here the outer and inner surface post-conditioning surface potentials are plotted as functions of the second stage rms emission currents (second stage charger rms emission currents equal). The data points of FIG. 8B were obtained using an rms emission current of about 500 $\mu$a for each first stage charger. Note that this condition (second stage emission currents =zero) produced post-conditioning surface potentials of about −480 volts on the outer face and about +440 volts on the inner face when the second stage was not used (see FIG. 8A). However, as shown by FIG. 8B, with second stage emission currents set to about 500 μa, the post-conditioning surface potentials of the outer and inner web faces are greatly reduced to the satisfactory values of about −44 volts and +25 volts, respectively. For yet higher second stage emission currents, up to 1,090 μa, the post-conditioning surface potentials are shown in FIG. 8B to be monotonically reduced to less than ±10 volts.

Figure 9A:
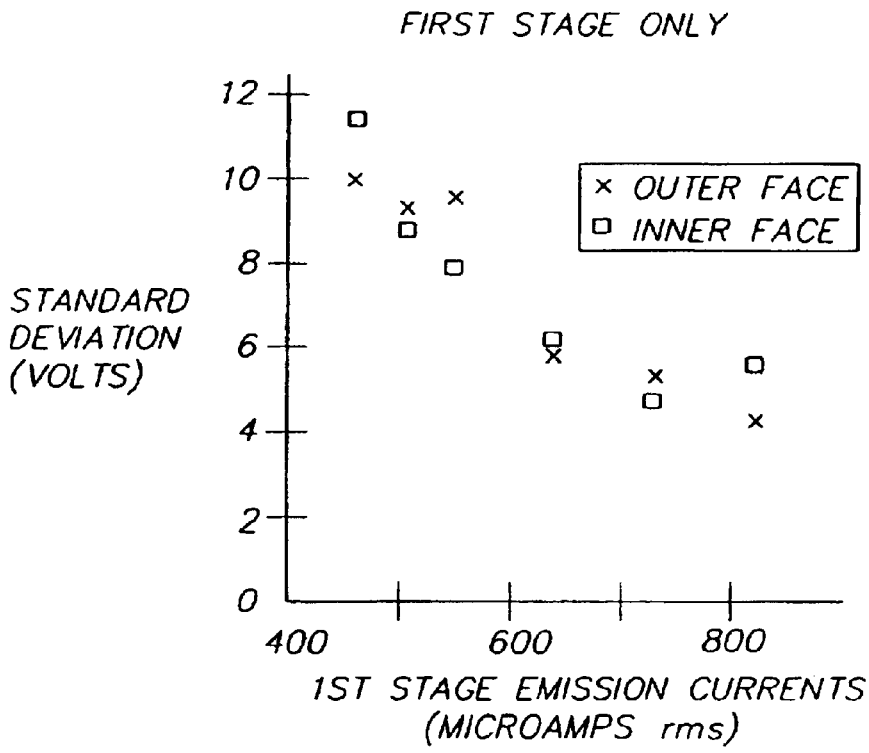
FIG. 9A shows standard deviations of post-conditioning surface potentials as functions of first stage emission current when using only the first stage of the web conditioning charging station.
Figure 9B:
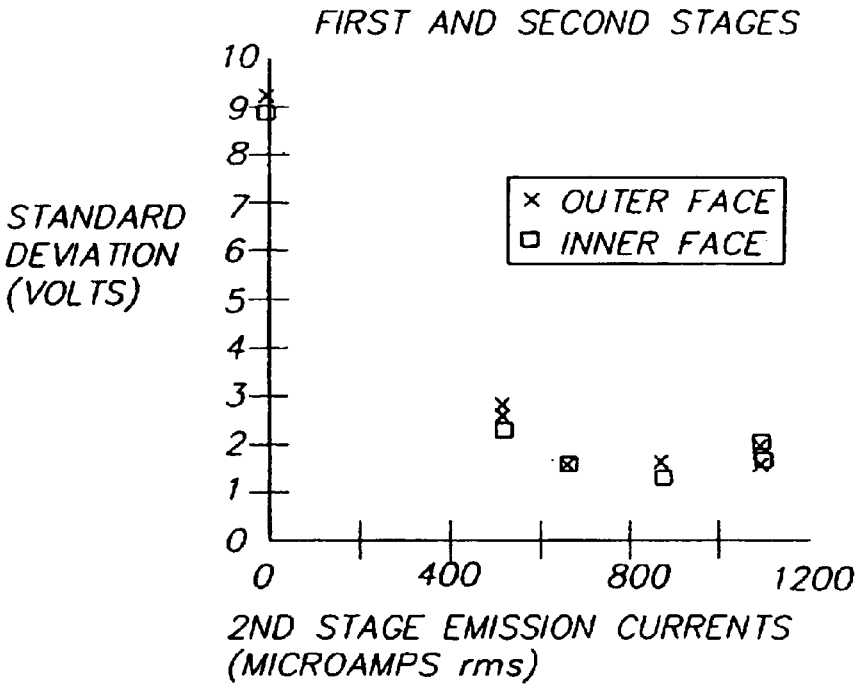
FIG. 9B shows standard deviations of post-conditioning surface potentials as functions of second stage emission current when using both the first and second stages of the web conditioning charging station.

In FIG. 9A are plotted standard deviations of the post-conditioning surface potentials of FIG. 8A, and in FIG. 9B are plotted standard deviations of the post-conditioning surface potentials of FIG. 8B. Thus FIG. 9A shows that without the use of the second stage of the web conditioning charging station, standard deviations are moderately large, i.e., in the neighborhood of about 11 volts for first stage emission currents of about 460 μa and falling to about 5 volts at about 810 μa. On the other hand, as shown in FIG. 9B, use of the second stage with the first stage emission currents set at 500 μa produces a significant improvement in the post-conditioning voltage uniformity. The standard deviation in FIG. 9B falls, from about 9 volts with the second stage turned off, to about 2–3 volts for second stage emission currents of 500 μa. Increasing the second stage emission currents to 1090 μa further reduced the standard deviation, to about 1–2 volts.

The data points of FIGS. 8A,B as well as other data points were provided as input to a computer optimization for minimizing the standard deviations using the "nominal" charger spacings of this Example. The optimized first-stage rms emission current was 625 μa, and the optimized second-stage rms emission current, 727 μa. With these setpoints, very high uniformity is predicted with standard deviations of only 1.1 volts (outer face) and 0.3 volts (inner face).

Example 5 demonstrates that, using the two-stage web conditioning charging station of the invention, the post-conditioning voltage across the transport web (and hence the post-conditioning polar charge density) can readily be kept well below the aim value of ±50 volts. Moreover, as seen from FIG. 8B, the magnitude of the post-conditioning voltage across the transport web is not sensitive to the value of the second-stage rms emission currents, at least for currents above about 500 μa, meaning that the apparatus is robust against changes in these currents, e.g., that may be caused by factors such as wire aging or changes in the ambient conditions. Similarly, the flatness of the one-stage response, as shown in FIG. 8A for first stage emission currents above about 550 μa, means that the output of the two-stage apparatus is also robust against changes in first stage emission currents such as may be caused by the same factors.

In summary, the web conditioning charging station of the invention has an improved performance and robustness over the prior art, with output voltage on the web being insensitive to the input charge level, with or without the use of a detack charger. In preferred operating mode the first stage of the web conditioning charging station advantageously knocks the incoming voltage (due to polar charge) down from four kilovolts or higher to a few hundred volts, and the second stage gets it down to a few tens of volts or lower. Moreover, the ungridded first stage chargers of the invention, having preferred plastic shells, are advantageously more efficient than prior art chargers having conductive shells. In addition, the preferred use of separate power regulation for each of the first stage and second stage chargers provides performance robustness, especially against spacing variations due to manufacturing or mounting tolerances, and the gridded second stage chargers also provide insensitivity to any first stage asymmetry. Another advantage of two-stage web conditioning is the ability to employ fixed charger spacings for both the first and second stages, thus generally eliminating time consuming adjustments and/or the need for costly mechanisms for adjusting these spacings.

The preferred design of the web conditioning charging station is advantageous in that all of the individual chargers embody the same construction and are made to be identical (except for the grid members attached to the second stage chargers), thereby resulting in low manufacturing and service costs. Moreover, the preferred design which includes aluminum support elements and steel end plates advantageously provides EMI screening of the corona wires.

Notwithstanding the above disclosure of the subject web conditioning charging station for use in an electrostatographic printing machine, the web conditioning charging station may have more general application for controlling surface charge density and voltage on a moving dielectric web, i.e., not necessarily a receiver-transporting web in an electrostatographic printer. Moreover, a web conditioning charging station of the invention, e.g., including embodiments 250, 300, 300', and 300", may be used for charge smoothing and/or for establishing a predetermined, uniform, potential difference across any moving dielectric web. To establish such a predetermined, uniform potential difference across a moving dielectric web, the grid members of the second stage of the web conditioning charging station are electrically biased to any suitable determinate potentials. Thus, a web conditioning charging station of the subject invention may include second-stage grid members biased to determinate potentials other than ground potential for certain applications, e.g., for use as otherwise disclosed in detail above in a modular electrostatographic printer. Furthermore, suitable first-stage and second-stage asymmetries are provided as may be necessary. Generally, when the incoming web carries a polar charge, it is preferable that a first-stage corona wire for charging that face of the web having the negative polarity of the polar charge be closer to the web than a first-stage corona wire for charging the face of the web having the positive polarity of the polar charge.

Thus a web conditioning charging station is disclosed for modifying a polar charge density and a net charge density carried on a moving dielectric web having a front surface and a back surface, the web conditioning charging station including: a first stage and a second stage. The dielectric web is moved successively through the first stage and the second stage. The first stage has a frontside open-wire corona charger facing the front surface of the web and a backside open-wire corona charger facing the back surface. The frontside open-wire corona charger includes one or more frontside open-wire corona wires energized by a frontside first-stage AC voltage waveform with no grid member interposed between the frontside first-stage corona wire(s) and the front surface. The backside first-stage corona charger includes one or more backside first-stage corona wires energized by a backside first-stage AC voltage waveform with no grid member interposed between the backside first-stage corona wire(s) and the back surface. The frontside first-stage AC voltage waveform is preferably 180 degrees out of phase with the backside first-stage AC voltage waveform. The second stage has a frontside gridded corona charger facing the front surface of the dielectric web and a backside gridded corona charger facing the back surface. The frontside gridded corona charger includes one or more frontside second-stage stage corona wires energized by a frontside second-stage AC voltage waveform, with a frontside electrically biasable grid member interposed between frontside second-stage corona wire(s) and the front surface. The backside gridded corona charger includes one or more backside second-stage corona wires energized by a backside second-stage AC voltage waveform with a backside electrically biasable grid member interposed between the backside second-stage corona wire(s) and the back surface. The frontside second-stage AC voltage waveform is preferably 180 degrees out of phase with the backside second-stage AC voltage waveform. The frontside and backside electrically biasable grid members are biased to any determinate potentials including ground potential, and any suitable first-stage and second-stage asymmetries are provided as may be necessary.

Moreover, a method of modifying a polar charge density and a net charge density on a dielectric web is disclosed, which method includes the steps of: energizing, by a respective upstream AC voltage waveform, each of two opposed open-wire corona chargers facing one another across the dielectric web, with each open-wire corona charger respectively including one or more corona wires; moving the dielectric web in a downstream direction past the open-wire corona chargers, the dielectric web passing in an upstream gap located between the two opposed open-wire corona chargers; energizing, by a respective downstream AC voltage waveform, each of two opposed gridded corona chargers facing one another across the dielectric web, with each gridded corona charger respectively including one or more corona wires; and, moving the dielectric web in the downstream direction past the gridded corona chargers, the dielectric web passing in a downstream gap located between the gridded corona chargers. Each gridded corona charger respectively includes an electrically biasable grid disposed between the dielectric web and the one or more downstream corona wires. Each respective upstream AC voltage waveform includes a respective upstream DC offset voltage, the respective upstream DC offset voltage including zero, and the respective downstream AC voltage waveform includes a respective downstream DC offset voltage, which respective downstream DC offset voltage includes zero volts. So as to accomplish the modifying of the polar charge density and the net charge density, the respective electrically biasable grid is biased to a respective determinate potential. The modifying includes producing a substantially uniform preselected potential difference across the dielectric web downstream of the gridded corona chargers, which preselected potential difference includes substantially zero volts. The above method is able to modify an incoming polar charge density, upstream of the two opposed open-wire corona chargers, that can exceed about 1.2 millicoulombs per square meter. Moreover, the method can be used for purposes of neutralizing the incoming polar charge density and neutralizing the incoming net charge density on the dielectric web, with the dielectric web being a transport web in the form of a rotatable endless belt for use in an electrostatographic printing machine. For these purposes, the respective determinate potential of the respective electrically biasable grid is preferably ground potential, and the respective upstream AC voltage waveform and said respective downstream AC voltage waveformn are preferably quasi-trapezoidal, the neutralizing producing on the transport web a residual polar charge density of magnitude less than about 13.7 microcoulombs per square meter. The method may alternatively be used for purposes of neutralizing the incoming net charge density on the dielectric web and producing a preselected residual polar charge density on the web downstream of the opposed gridded chargers, where the dielectric web is a transport web in the form of a rotatable endless belt for use in an electrostatographic printing machine, and preferably the respective upstream AC voltage waveform and the respective downstream AC voltage waveformn are quasi-trapezoidal.

The invention has been described in detail with particular reference to certain preferred embodiments thereof, but it will be understood that variations and modifications can be effected within the spirit and scope of the invention.

What is claimed is:

1. A web conditioning charging station for use in an electrostatographic printing apparatus, said electrostatographic printing apparatus including a transport web, said transport web being dielectric in the form of a rotatable endless belt, said transport web for purpose of moving receiver members through at least one electrostatographic imaging module included in said electrostatographic printing apparatus, such that toner images formed in said at least one electrostatographic imaging module are electrostatically transferred to said receiver members, said transport web having an outer surface and an inner surface, said receiver members adhering to said outer surface prior to said moving said receiver members through said at least one electrostatographic imaging module, said receiver members detacked from said transport web, said transport web carrying post-detack electrostatic charges representable by a polar charge density and a net charge density, said web conditioning charging station for purpose of modifying said polar charge density and said net charge density, said web conditioning charging station comprising:

a first stage, said first stage having opposed open-wire corona chargers including an outer open-wire corona charger facing said outer surface of said transport web and an inner open-wire corona charger facing said inner surface of said transport web, said outer open-wire corona charger including an outer first-stage corona wire substantially parallel to said outer surface and energized by an outer first-stage AC voltage waveform, said inner open-wire corona charger including an inner first-stage corona wire substantially parallel to said inner surface and energized by an inner first-stage AC voltage waveform, said outer first-stage AC voltage waveform 180 degrees out of phase with said inner first-stage AC voltage waveform;

a second stage, said second stage having opposed gridded corona chargers including an outer gridded corona charger facing said outer surface and an inner gridded corona charger facing said inner surface of said transport web, said outer gridded corona charger including an outer second-stage stage corona wire substantially parallel to said outer surface and energized by an outer second-stage AC voltage waveform, with a grounded outer grid interposed between said outer second-stage corona wire and said outer surface, said outer grid being conductive and substantially parallel to said outer surface, said inner gridded corona charger including an inner second-stage corona wire substantially parallel to said inner surface and energized by an inner second-stage AC voltage waveform, with a grounded inner grid interposed between said inner second-stage corona wire and said inner surface, said inner grid being conductive and substantially parallel to said inner surface, said outer second-stage AC voltage waveform 180 degrees out of phase with said inner second-stage AC voltage waveform; and, wherein said transport web is moved successively through said first stage and said second stage after passage through said at least one electrostatographic imaging module for modifying said polar charge density and said net charge density, said modifying being for purpose of neutralizing said polar charge density and said net charge density, and said first stage accomplishes at least about 80% of said neutralizing of said polar charge density.

2. A web conditioning charging station according to claim 1, wherein after said neutralizing, said polar charge density has a residual magnitude less than about 13.7 microcoulombs per square meter following passage of said web through said first stage and said second stage.

3. A web conditioning charging station according to claim 1, wherein said outer grid and said inner grid are electrically biased to determinate potentials, and said modifying is for purpose of providing a predetermined, uniform, potential difference across said transport web after passage of said web through said first stage and said second stage.

4. A web conditioning charging station according to claim 1, wherein said open-wire corona chargers and said gridded corona chargers are supported by a supporting structure provided in common.

5. A web conditioning charging station according to claim 4, wherein for purpose of changing or servicing said transport web said supporting structure is dissectible into an upper section and a readily removable lower section, said lower section including tracks for holding said outer open-wire charger and tracks for holding said outer gridded charger, said upper section including tracks for holding said inner open-wire charger and tracks for holding said inner gridded charger.

6. A web conditioning charging station according to claim 4, wherein for purpose of guiding said transport web moving under tension through said web conditioning charging station, said supporting structure is provided with at least one web-supporting member located near the entrance of said web conditioning charging station and near the exit of said web conditioning charging station.

7. A web conditioning charging station according to claim 1, wherein said open-wire corona chargers are supported by a first-stage supporting structure and said second stage corona chargers are supported by a second-stage supporting structure, said first-stage supporting structure and said second stage supporting structure being physically separated by a distance along the direction of travel of said transport web.

8. A web conditioning charging station according to claim 7, wherein a web cleaning station is located between said first-stage supporting structure and said second stage supporting structure, said open-wire chargers producing a preselected voltage polarity and a preselected potential difference across said transport web so as to provide a suitable first-stage conditioning of said transport web prior to said transport web entering said web cleaning device.

9. A web conditioning charging station according to claim 1, wherein:

said outer first-stage AC voltage waveform and said inner first-stage AC voltage waveform have a first-stage frequency in common;

said outer second-stage AC voltage waveform and said inner second-stage AC voltage waveform have a second-stage frequency in common; and wherein there is a frequency difference between said first-stage frequency and said second-stage frequency, said frequency difference including zero.

10. A web conditioning charging station according to claim 1, wherein:

said outer first-stage AC voltage waveform has an outer first-stage DC offset, said outer first-stage DC offset including zero;

said inner first-stage AC voltage waveform has an inner first-stage DC offset, said inner first-stage DC offset including zero;

said outer second-stage AC voltage waveform has an outer second-stage DC offset, said outer second-stage DC offset including zero; and said inner second-stage AC voltage waveform has an inner second-stage DC offset, said inner second-stage DC offset including zero.

11. A web conditioning charging station according to claim 1, wherein each of said outer first-stage AC voltage waveform, said inner first-stage AC voltage waveform, said outer second-stage AC voltage waveform, and said inner second-stage AC voltage waveform has a substantially quasi-trapezoidal shape.

12. A web conditioning charging station according to claim 11, wherein for a frequency of less than or equal to 600 Hz, each of said outer first-stage AC voltage waveform, said inner first-stage AC voltage waveform, said outer second-stage AC voltage waveform, and said inner second-stage AC voltage waveform has a risetime in a range of approximately between 75 $\mu$s and 275 $\mu$s and a falltime in a range of approximately between 75 $\mu$s and 275 $\mu$s.

13. A web conditioning charging station according to claim 12, wherein said risetime and said falltime each lies in a range of approximately between 200 $\mu$s and 250 $\mu$s.

14. A web conditioning charging station according to claim 11, wherein for any frequency greater than 600 Hz represented by $\phi$, each of said outer first-stage AC voltage waveform, said inner first-stage AC voltage waveform, said outer second-stage AC voltage waveform, and said inner second-stage AC voltage waveform has a risetime and a falltime equal in magnitude, said magnitude inversely proportional to frequency, said magnitude calculable as $(600\tau/\phi)$ where $\tau$ represents an operationally useful risetime and falltime for use at any frequency less than or equal to 600 Hz.

15. A web conditioning charging station according to claim 1, wherein said outer first-stage AC voltage waveform is in phase with said outer second-stage AC voltage waveform, and wherein said inner first-stage AC voltage waveform is in phase with said inner second-stage AC voltage waveform.

16. A web conditioning charging station according to claim 1, wherein:

at least one additional outer first-stage corona wire is mounted substantially parallel to said outer first-stage corona wire in said outer open-wire charger, said at least one additional outer first-stage corona wire and said outer first-stage corona wire substantially equidistant from said outer surface, said at least one additional outer first-stage corona wire energized by said outer first-stage AC voltage waveform; and at least one additional inner first-stage corona wire is mounted substantially parallel to said inner first-stage corona wire in said inner open-wire charger, said at least one additional inner first-stage corona wire and said inner first-stage corona wire substantially equidistant from said inner surface, said at least one additional inner first-stage corona wire energized by said inner first-stage AC voltage waveform.

17. A web conditioning charging station according to claim 1, wherein:

at least one additional outer second-stage corona wire is mounted substantially parallel to said outer second-stage corona wire in said outer gridded charger, said at least one additional outer second-stage corona wire and said outer second-stage corona wire substantially equidistant from said Outer surface, said at least one additional outer second-stage corona wire energized by said outer second-stage AC voltage waveform; and at least one additional inner second-stage corona wire is mounted substantially parallel to said inner second-stage corona wire in said inner gridded charger, said at least one additional inner second-stage corona wire and said inner second-stage corona wire substantially equidistant from said inner surface, said at least one additional inner second-stage corona wire energized by said inner second-stage AC voltage waveform.

18. A web conditioning charging station according to claim 1, wherein each of said opposed open-wire corona chargers, and said opposed gridded chargers includes a similar shell made of a dielectric material, said similar shell including a back wall and two sidewalls partially enclosing the respective corona wire included in said each of said opposed open-wire corona chargers and said opposed gridded chargers.

19. A web conditioning charging station according to claim 18, wherein said similar shell forms three sides of a hollow shape having substantially planar interior surfaces, said interior surfaces forming three sides of a rectangle, said back wall including an inner back shell surface substantially parallel to said respective corona wire.

20. A web conditioning charging station according to claim 19, wherein a respective grid member of each of said opposed gridded chargers is attached to the respective shell so as to form a fourth side of said rectangle, and wherein a respective grid included in said respective grid member is substantially parallel to the respective corona wire included in said each of said opposed gridded chargers.

21. A web conditioning charging station according to claim 20, wherein:

said dielectric material is the same for each shell included in said opposed open-wire chargers and said opposed gridded chargers;

said each shell has substantially the same shell dimensions;

each said respective grid member of said opposed gridded chargers has substantially the same grid member dimensions and is made of a grid member material which is the same for both gridded chargers;

said respective corona wire included in said each of said opposed open-wire corona chargers and said opposed gridded chargers has the same corona wire diameter and is made of the same corona wire material.

22. A web conditioning charging station according to claim 20, wherein said dielectric material is a modified polysulfone including 30% chopped glass, fibers, said grid member material is stainless steel, said corona wire diameter is in a range of approximately between 0.0015 inch and 0.005 inch, and said corona wire material includes tungsten.

23. A web conditioning charging station according to claim 1 wherein:

a first-stage asymmetry is defined by ((a perpendicular distance between said inner first-stage corona wire and said transport web)) minus ((a perpendicular distance between said outer first-stage corona wire and said transport web)) divided by (a perpendicular distance between said inner first-stage corona wire and said outer first-stage corona wire); and a second-stage asymmetry is defined by ((a perpendicular distance between said inner grid and said transport web) minus (a perpendicular distance between said outer grid and said transport web)) divided by (a perpendicular distance between said inner grid and said outer grid).

24. A web conditioning charging station according to claim 23, wherein;

said outer surface of said transport web is negatively charged;

said first-stage asymmetry is in a range of approximately between 0.14 and 0.64; and said second-stage asymmetry is approximately 0.00±0.75.

25. A web conditioning charging station according to claim 24, wherein said first-stage asymmetry is in a range of approximately between 0.14 and 0.37; and said second-stage asymmetry is approximately 0.00±0.50.

26. A web conditioning charging station according to claim 23, wherein;

said outer surface of said transport web is positively charged;

said first-stage asymmetry is in a range of approximately between −0.14 and −0.64; and said second-stage asymmetry is approximately 0.00±0.75.

27. A web conditioning charging station according to claim 24, wherein said first-stage asymmetry is in a range of approximately between −0.14 and −0.37; and said second-stage asymmetry is approximately 0.00±0.50.

28. A web conditioning charging station according to claim 23, wherein fixed and non-adjustable spacings are provided for the following:

said perpendicular distance between said inner first-stage corona wire and said transport web;

said perpendicular distance between said outer first-stage corona wire and said transport web;

said perpendicular distance between said inner grid and said transport web; and said perpendicular distance between said outer grid and said transport web.

29. A web conditioning charging station according to claim 28, wherein said outer open-wire charger, said inner open-wire charger, said outer gridded charger and said inner gridded charger are mounted on a supporting structure provided in common.

30. A web conditioning charging station according to claim 23, wherein at least one of the following is adjustable by a spacing adjusting mechanism:

said perpendicular distance between said inner first-stage corona wire and said transport web;

said perpendicular distance between said outer first-stage corona wire and said transport web;

said perpendicular distance between said inner grid and said transport web; and said perpendicular distance between said outer grid and said transport web.

31. A web conditioning charging station according to claim 1, wherein voltage waveforms for activating said open-wire chargers and said gridded chargers are provided by a power unit, said power unit comprising:

two regulated separately controllable first-stage outputs for respectively generating an outer first-stage AC voltage waveform and an inner first-stage AC voltage waveform; and two regulated separately controllable second-stage outputs for respectively generating an outer second-stage AC voltage waveform and an inner second-stage AC voltage waveform.

32. A web conditioning charging station according to claim 31, wherein said voltage waveforms have a frequency in common lying in a range of approximately between 280 Hz and 600 Hz.

33. A web conditioning charging station according to claim 32, wherein said frequency in common is about 400 Hz±20 Hz.

34. A web conditioning charging station according to claim 31, wherein each of said two regulated separately controllable first-stage outputs is individually regulated to provide a respective first-stage rms AC current per unit length of corona wire, and each of said two regulated separately controllable second-stage outputs is individually regulated to provide a respective second-stage rms AC current per unit length of corona wire.

35. A web conditioning charging station according to claim 34, wherein;

said respective first-stage rms current per unit length of corona wire has a predetermined value in a range of approximately between 1.1 ma/m and 3.3 ma/m at a frequency of 400 Hz; and said respective second-stage rms current per unit length of corona wire has a predetermined value in a range of approximately between 1.1 ma/m and 3.3 ma/m at a frequency of 400 Hz.

36. A web conditioning charging station according to claim 35, wherein:

said respective first-stage rms current per unit length of corona wire is about 1.91±0.14 ma/m; and said respective second-stage rms current per unit length of corona wire is about 1.69±0.14 ma/m.

37. A web conditioning charging station according to claim 31, wherein said two regulated separately controllable second-stage outputs are individually connected via a respective high voltage line to said outer second-stage corona wire and said inner second-stage corona wire, with at least one capacitor included in a respective combination capacitance inserted in each said respective high voltage line, which respective combination capacitance includes capacitors connected in parallel, in series, and in parallel and series combinations.

38. A web conditioning charging station according to claim 36, wherein said respective combination capacitance has a same value in each said high voltage line, said same value lying in a range of approximately between 0.005 $\mu$F–0.5 $\mu$F for a frequency of about 400 Hz.

39. A web conditioning charging station according to claim 38, said same value lying in a range of approximately between 0.05 $\mu$F –0.15 $\mu$F for a frequency of about 400 Hz.

40. A web conditioning charging station according to claim 1, wherein a distance between said outer first-stage corona wire and said inner first-stage corona wire is in a range of approximately between 8 mm and 16 mm.

41. A web conditioning charging station according to claim 40, wherein said distance between said outer first-stage corona wire and said inner first-stage corona wire is 11.2±1.5 mm.

42. A web conditioning charging station according to claim 1, wherein a distance between said outer grid and said inner grid is in a range of approximately between 2 mm and 5 mm.

43. A web conditioning charging station according to claim 42, wherein said distance between said outer grid and said inner grid is 3.0±0.5 mm.

44. A method of modifying a polar charge density and a net charge density on a dielectric web, said method comprising the following steps of:

energizing each of two opposed open-wire corona chargers facing one another across said dielectric web, said energizing each by a respective upstream AC voltage waveform, said each of two opposed open-wire corona chargers comprising at least one respective upstream corona wire;

moving said dielectric web in a downstream direction past said two opposed open-wire corona chargers, said dielectric web passing in an upstream gap located between said two opposed open-wire corona chargers;

energizing each of two opposed gridded corona chargers facing one another across said dielectric web, said energizing each by a respective downstream AC voltage waveform, said each of two opposed gridded corona chargers comprising at least one respective downstream corona wire;

moving said dielectric web in said downstream direction past said two opposed gridded corona chargers, said opposed gridded corona chargers located downstream from said two opposed open-wire corona chargers, said dielectric web passing in a downstream gap located between said two opposed gridded corona chargers;

wherein each said two opposed gridded corona chargers includes a respective electrically biasable grid, said respective electrically biasable grid disposed between said dielectric web and said at least one respective downstream corona wire;

wherein said respective upstream AC voltage waveform includes a respective upstream DC offset voltage, said respective upstream DC offset voltage including zero volts;

wherein said respective downstream AC voltage waveform includes a respective downstream DC offset voltage, said respective downstream DC offset voltage including zero volts;

wherein said respective electrically biasable grid is biased to a respective determinate potential for said modifying, said modifying including producing a substantially uniform preselected potential difference across said dielectric web, said preselected potential difference across said dielectric web including substantially zero volts; and wherein said polar charge density, upstream of said two opposed open-wire corona chargers, can exceed about 1.2 millicoulombs per square meter and said modifying neutralizes said polar charge density and neutralizes said net charge density on said dielectric web, and at least 80% of the neutralizing of said polar charge density is accomplished by said two opposed open-wire corona chargers.

45. The method of claim 44, wherein:

said respective determinate potential of said respective electrically biasable grid is ground potential for each said two opposed gridded corona chargers;

said respective upstream AC voltage waveform and said respective downstream AC voltage waveform are quasi-trapezoidal; and downstream of said two opposed gridded corona chargers, said neutralizing produces on said transport web a residual polar charge density of magnitude less than about 13.7 microcoulombs per square meter.

* * * * *